US009337532B2

(12) United States Patent
Vanjani et al.

(10) Patent No.: US 9,337,532 B2
(45) Date of Patent: May 10, 2016

(54) MULTI LAYER 3D ANTENNA CARRIER ARRANGEMENT FOR ELECTRONIC DEVICES

(71) Applicant: Futurewei Technologies, Inc., Plano, TX (US)

(72) Inventors: Kiran Vanjani, San Diego, CA (US); Jorge Fabrega Sanchez, San Diego, CA (US); Hui Vicki Tan, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 510 days.

(21) Appl. No.: 13/622,134

(22) Filed: Sep. 18, 2012

(65) Prior Publication Data

US 2014/0078017 A1 Mar. 20, 2014

(51) Int. Cl.

| | |
|---|---|
| ***H01Q 1/12*** | (2006.01) |
| ***H01Q 1/38*** | (2006.01) |
| ***H01Q 1/24*** | (2006.01) |
| ***H01Q 5/371*** | (2015.01) |
| ***H01Q 9/04*** | (2006.01) |

(52) U.S. Cl.

CPC ..... *H01Q 1/38* (2013.01); *H01Q 1/243* (2013.01); *H01Q 5/371* (2015.01); *H01Q 9/0414* (2013.01); *H01Q 9/0471* (2013.01)

(58) Field of Classification Search

USPC ..... 343/700 MS, 702, 878

See application file for complete search history.

(56) References Cited

U.S. PATENT DOCUMENTS

| | | | | |
|---|---|---|---|---|
| 6,040,806 | A * | 3/2000 | Kushihi et al. | 343/853 |
| 6,147,650 | A * | 11/2000 | Kawahata et al. | 343/700 MS |
| 6,992,627 | B1 * | 1/2006 | Honda et al. | 343/700 MS |
| 2002/0175864 | A1 * | 11/2002 | Fang et al. | 343/702 |
| 2005/0099344 | A1 | 5/2005 | Okubo et al. | |

(Continued)

FOREIGN PATENT DOCUMENTS

| | | | |
|---|---|---|---|
| CN | 101572340 | A | 11/2009 |
| CN | 101573831 | A | 11/2009 |

(Continued)

OTHER PUBLICATIONS

Foreign Communication From a Counterpart Application, PCT Application No. PCT/CN2013/083784, International Search Report dated Dec. 26, 2013, 6 pages.

(Continued)

*Primary Examiner* — Tan Ho

(74) *Attorney, Agent, or Firm* — Conley Rose, P.C.; Grant Rodolph; Adam J. Stegge

(57) ABSTRACT

An antenna comprising a plurality of carrier blocks, wherein each carrier block is coupled to at least one other carrier block, and a plurality of radiators, wherein each radiator is connected to at least one carrier block. Further, an antenna comprising a plurality of carrier blocks, wherein each carrier block is coupled with at least one other carrier block, and a radiator connected to at least two of the plurality of carrier blocks.

35 Claims, 24 Drawing Sheets

(56) References Cited

U.S. PATENT DOCUMENTS

| | | | | |
|---|---|---|---|---|
| 2008/0067715 | A1 | 3/2008 | Sung | |
| 2009/0135082 | A1 | 5/2009 | Hou | |
| 2009/0174612 | A1 | 7/2009 | Ayala et al. | |
| 2009/0267843 | A1 | 10/2009 | Wu et al. | |
| 2009/0273531 | A1 | 11/2009 | Ishizuka et al. | |
| 2010/0097272 | A1* | 4/2010 | Kim et al. | 343/700 MS |
| 2011/0043408 | A1 | 2/2011 | Shi et al. | |
| 2011/0134015 | A1 | 6/2011 | Yang et al. | |
| 2011/0148716 | A1 | 6/2011 | Sotoma et al. | |
| 2011/0304520 | A1 | 12/2011 | Djordjevic et al. | |
| 2012/0218166 | A1 | 8/2012 | Jiang | |

FOREIGN PATENT DOCUMENTS

| | | | |
|---|---|---|---|
| CN | 101702470 | A | 5/2010 |
| JP | 2010130100 | A | 6/2010 |
| KR | 20080002338 | U | 7/2008 |
| WO | 2008082088 | A1 | 7/2008 |
| WO | 2008102950 | A1 | 8/2008 |

OTHER PUBLICATIONS

Foreign Communication From a Counterpart Application, PCT Application No. PCT/CN2013/083784, Written Opinion dated Dec. 26, 2013, 5 pages.

Foreign Communication From a Counterpart Application, European Application No. 13838744.4, Extended European Search Report dated Jul. 17, 2015, 10 pages.

Foreign Communication From A Counterpart Application, Korean Application No. 10-2015-7008703, Korean Office Action dated Nov. 12, 2015, 8 pages.

Foreign Communication From A Counterpart Application, Korean Application No. 10-2015-7008703, English Translation of Korean Office Action dated Nov. 12, 2015, 6 pages.

Foreign Communication From A Counterpart Application, Chinese Application No. 201380045594.1, Chinese Office Action dated Jan. 29, 2016, 7 pages.

Foreign Communication From A Counterpart Application, Chinese Application No. 201380045594.1, Chinese Search Report dated Jan. 19, 2016, 2 pages.

* cited by examiner

MULTI LAYER 3D ANTENNA CARRIER ARRANGEMENT FOR ELECTRONIC DEVICES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In modern wireless communication systems, antennas are used in a wide variety of electronic devices, such as mobile phones, personal digital assistant (PDA), wireless routers, hand-held tablets, laptops, etc., for transmitting and receiving radio signals. Depending on application, antennas may transmit and receive radio waves at various frequency bands. For example, mobile phones may use antennas to realize wireless communications with base stations at specific cellular frequencies such as 850 megahertz (MHz), 900 MHz, 1800 MHz, and 1900 MHz. Wireless routers, cellular phones may use antennas to communicate at Wi-Fi frequencies such as 2400 MHz and 5000 MHz. In fact, more and more functionalities (e.g., global positioning system (GPS), wireless local area networks (Wi-Fi), Bluetooth, cellular communication, etc.) are now being integrated into a single portable electronic device such as a smartphone. As a result, the number of frequency bands needed to incorporate into a single device is ever increasing. On the other hand, the size of portable electronic devices is fixed or reducing, which in turn imposes strict limitations on the available space where one or more antennas may be housed. Therefore, it is desirable for antenna designers to provide improved antenna structures which utilize the limited antenna space more efficiently.

SUMMARY

In one embodiment, the disclosure includes an antenna comprising a plurality of carrier blocks, wherein each carrier block is coupled to at least one other carrier block, and a plurality of radiators, wherein each radiator is connected to at least one carrier block.

In another embodiment, the disclosure includes an antenna comprising a plurality of carrier blocks, wherein each carrier block is coupled with at least one other carrier block, and a radiator connected to at least two of the plurality of carrier blocks.

In yet another embodiment, the disclosure includes an antenna comprising a plurality of antenna carriers, wherein each antenna carrier is coupled to at least one other antenna carrier physically, chemically, or both, and at least one radiator connected to at least one of the plurality of antenna carriers.

In yet another embodiment, the disclosure includes electronic communication device comprising an antenna comprising a carrier, wherein the carrier comprises an internal part and an external part, wherein each of the internal and external parts comprises at least one surface and a radiator coupled to the carrier, wherein at least part of the radiator extends over the internal part.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
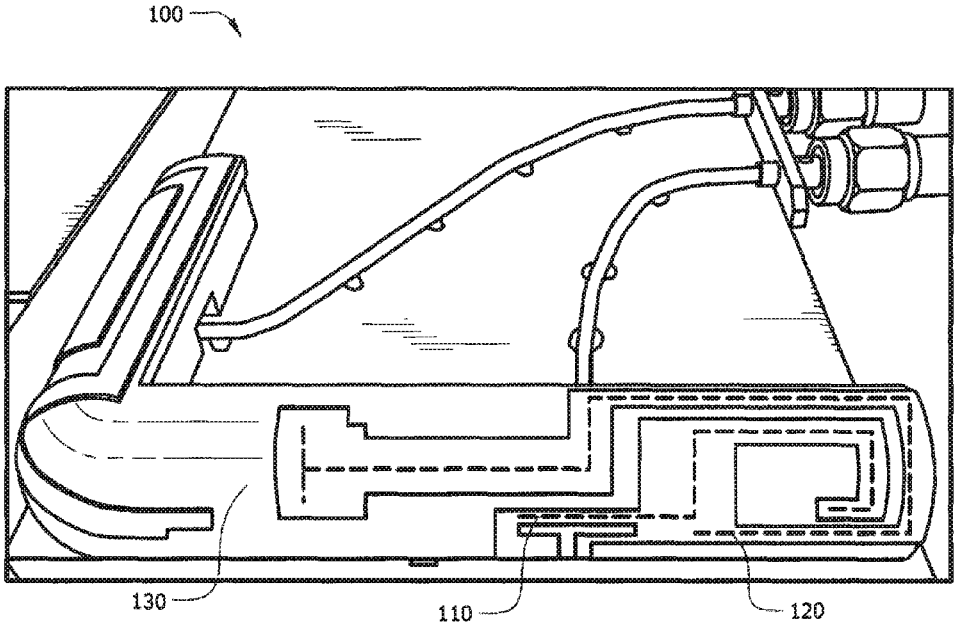
FIG. 1 is an image of a prototype of an inverted-F antenna (IFA).

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents. The drawing figures are not necessarily to scale. Certain features of embodiments may be shown exaggerated in scale or in somewhat schematic form and some details of conventional elements may not be shown in the interest of clarity and conciseness.

In electronic devices that require wireless communication, an antenna may be used in conjunction with a radio transceiver for transmitting and receiving electromagnetic waves. In use, an antenna may comprise at least one radiator and an antenna carrier. The radiator may take the form of a thin film of conductive material, such as copper, silver, gold and other metals alike. Also, the radiator may be routed (or patterned)

into one or more radiator branches (or traces) of a certain geometry. The antenna may utilize resonant currents generated from the radiator to transmit and/or receive radio signals. Furthermore, radio signals received by the antenna and/or output from the antenna may be implemented by connecting the radiator to a feed line, which may be connected to the transceiver. The antenna carrier may be made from a non-conductive material and serve as a supporting substrate or platform for the radiator. In use, the antenna carrier may comprise one or more carrier blocks.

The operational frequency bands of an antenna may be determined by a number of parameters such as the geometry (e.g., length) of radiator branches. For example, a longer radiator branch may lead to a lower frequency band, and a shorter radiator branch may lead to a higher frequency band. FIG. 1 shows an image of a prototype of an inverted-F antenna (IFA) 100, which comprises a first antenna branch 110 and a second antenna branch 120 supported by an antenna carrier 130. For purpose of illustration, the approximated routed traces of the two branches are marked in black dashed lines. As shown in FIG. 1, the first antenna branch 110 has a relatively shorter length, thus it may operate at a higher frequency band (e.g., 1800 MHz or 1900 MHz). The second antenna 120 has a relatively longer length, thus it may operate at a lower frequency band (e.g., 700 MHz, 850 MHz, or 900 MHz).

In practice, the radiator branches may reside on a surface of the antenna carrier 130, which may serve as a supporting platform for the radiator. To accommodate consumer demands for more functionalities (or features) integrated into a single portable electronic device, one or more antennas of the portable electronic device may need to incorporate an increasing number of frequency bands. In the design of an antenna, more frequency bands may be achieved, for example, by routing more radiator branches of varying lengths on the surface of the antenna carrier. Currently, only the outside (or external) surface of the antenna carrier (e.g., the antenna carrier 130 in FIG. 1) may be used to pattern radiator branches. Consequently, there may be potential limitations or problems associated with current designs of the antenna carrier. Since more radiator branches may cover a large surface area, within a limited antenna space (or volume), the total surface area of the antenna carrier may be insufficient to encompass all required frequency bands. As portable electronic devices today may be miniaturizing in size while integrating more functionalities, the allowed antenna space, although already small, may be further declining. Moreover, aggressive industrial designs (ID) of electronic devices may adopt special features on the antenna carrier, such as rounded smooth surfaces (e.g., the antenna carrier 130 in FIG. 1), which may reduce the total surface area even more.

Disclosed herein are antennas comprising one or more antenna carrier blocks that provide more efficient usage of a given antenna space. The one or more carrier blocks of a disclosed antenna may have any suitable three-dimensional (3D) shapes and may be coupled in a way such that the overall surface area of the disclosed antenna may be increased in comparison to conventional antenna carriers. The carrier blocks may support one or more radiators, which may be routed on any surface of the carrier blocks, thereby increasing the number of frequency bands that can be integrated into the antenna. In an embodiment, a first carrier block may comprise a top surface (or face), a bottom surface with a different area from the top surface, and one or more intermediate layers (or surfaces) in between. In addition, a second carrier block may comprise arc-shaped convex and concave surfaces that comply with ID specifications. The first carrier block and the second carrier block may be coupled in any relative positions to realize efficient usage of the given antenna space. One or more radiators may be routed on any face (surface, or layer) of the first carrier block and/or the second carrier block. As a result, an antenna as disclosed may utilize the limited antenna space more efficiently and effectively, which may lead to miniaturization in the antenna volume and/or the incorporation of more frequency bands. In an embodiment, a disclosed antenna may also comprise a single-block carrier and a radiator. The carrier may be a relatively complex carrier comprising an internal part and an external part, and part of the radiator may extend over the internal part. Moreover, depending on application, radiator branches of certain frequency bands may be routed on specific regions of the carrier blocks, so that the antenna performance may be optimized for particular use cases. As used herein, "top", "bottom", "front", "back", "left", and "right" or any other term that references a relative position is with respect to the perspective view referenced and does not mean to imply that a device is restricted to only one orientation.

Figure 2A:
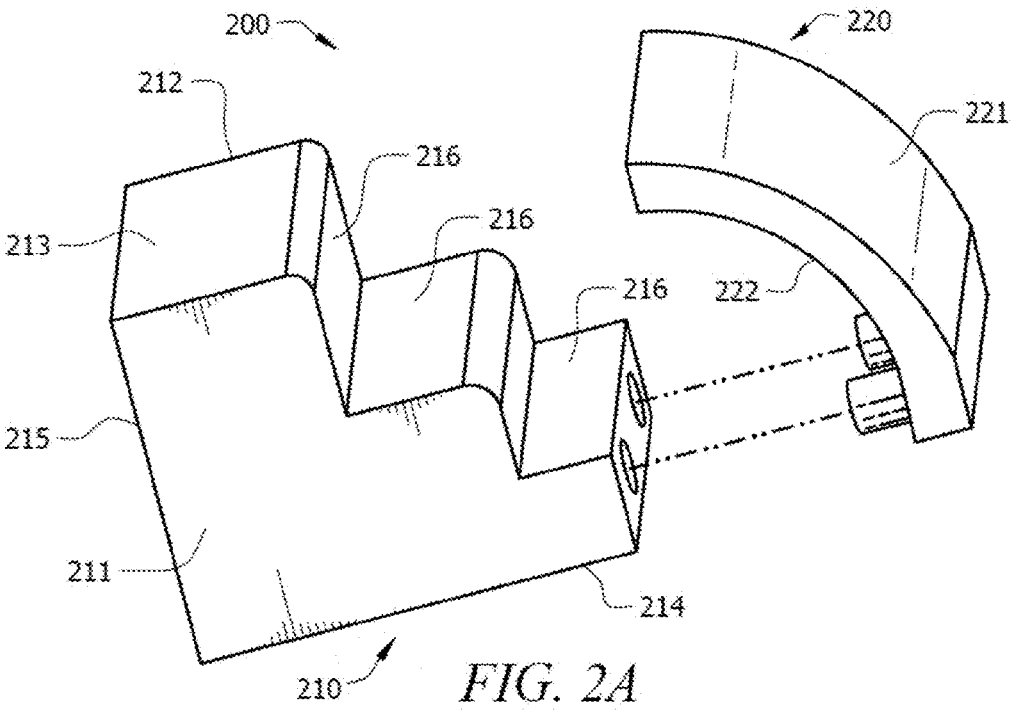
FIGS. 2A-2C are perspective views of an embodiment of an antenna carrier.
Figure 2B:
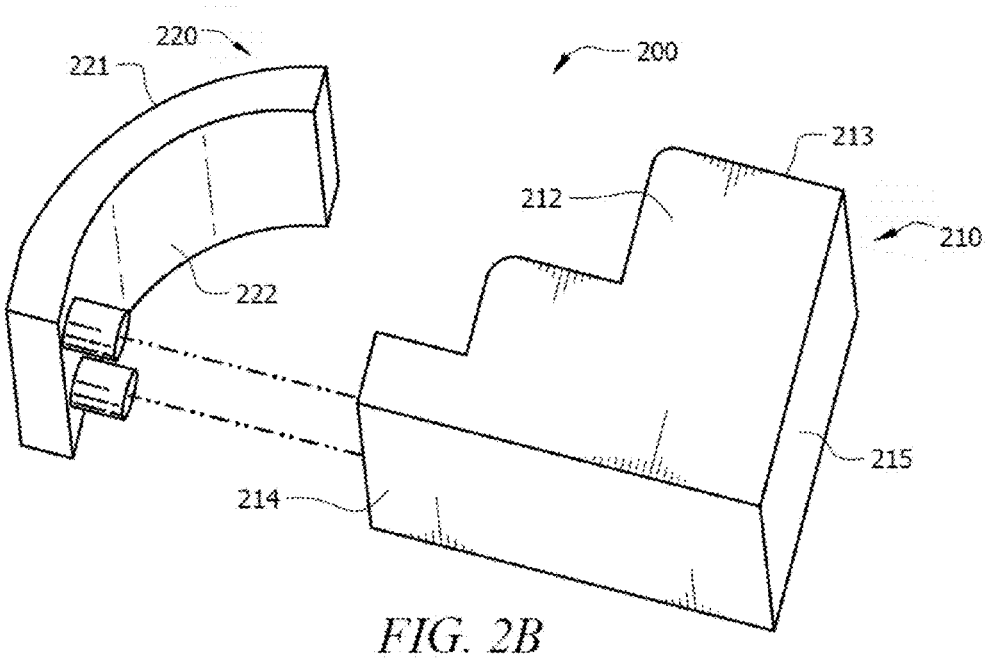
Figure 2C:
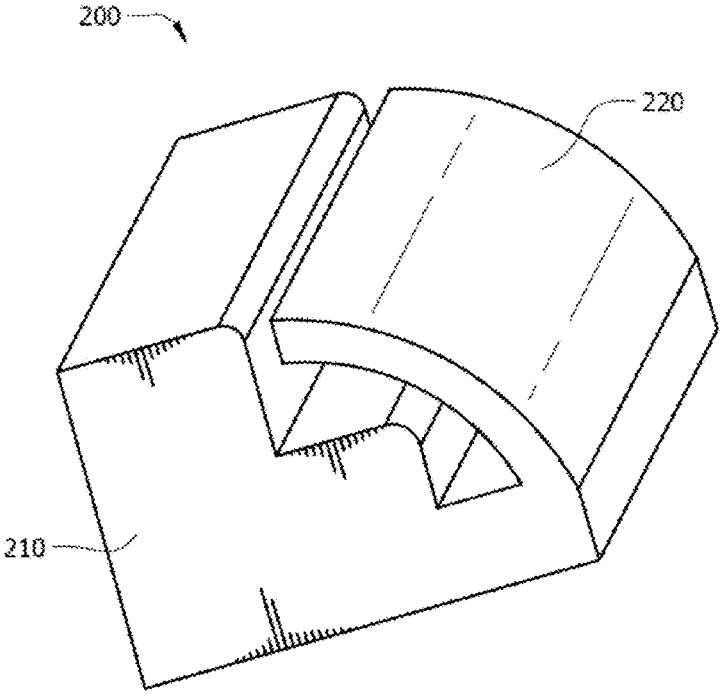

FIGS. 2A-2C show perspective views of an embodiment of an antenna carrier 200. The antenna carrier 200 may comprise a first carrier block 210 and a second carrier block 220, each of which may have any arbitrary 3D shape. The term "block" herein may refer to an object or entity that is separate to other objects (at least at a time when the object is first fabricated), thus merely a section or portion of the object (e.g., a left section or a right section arbitrarily defined) may not be regarded as a block. In practice, the shapes of the carrier blocks may be designed in a way such that, in comparison to a rectangular block, a larger total surface area may be created. For example, the first carrier block 210 comprises a left surface (or face) 211, a right surface 212, a top surface 213, a bottom surface 214 with a different area from the top surface 213, a back surface 215, and one or more intermediate layers (surfaces) 216 in between, as shown in FIGS. 2A and 2B. According to one embodiment, the plurality of planar surfaces 216 are configured in a stair-stepped pattern as shown in FIG. 2A. The number of intermediate layers may be application dependent. For example, each intermediate layer may comprise a first planar surface and a second planar surface. The first planar surface may intersect with the second planar surface with any angle. In another embodiment, the intermediate layer may comprise one or more curved surface. For example, as shown in FIGS. 2A and 2B, the first planar surface and the second planar surface may be perpendicular (or approximately perpendicular) to each other. Alternatively, instead of having intermediate layers between the top surface 213 and the bottom surface 214, the carrier block 210 may comprise one or more tilted faces connecting the top surface 213 and the bottom surface 214. The carrier block 210 may take form of a polyhedron with planar surfaces and straight edges. Alternatively, the carrier block 210 may include one or more curved surfaces and/or curved edges (e.g., the rounded corners between the first planar surface and the second planar surface of an intermediate layer 216 shown in FIG. 2A). If desired, the carrier block 210 may also comprise one or more surface features designed to increase its total surface area. For example, one or more faces of the carrier block 210 may comprise corrugations, castellations, scallops, concave trenches, convex protrusions, any other features, or any combination thereof.

The carrier block 210 may be made of any material that is suitable for use in an antenna. Suitable structural materials may include, but are not limited to, plastic materials such as polycarbonate (PC), polystyrene (PS), polyethylene terephthalate (PET), acrylonitrile butadiene styrene (ABS), ceramic materials, any other suitable materials, and any combination thereof. In addition, the carrier block 210 may be manufactured via any of a variety of techniques. Possible manufacturing techniques may include, but are not limited to, extrusion, injection molding, blow molding, thermoforming, rotational molding, casting, foaming, compression molding, transfer molding, any other manufacturing techniques, and any combination thereof.

Likewise, the second carrier block 220 may also have an arbitrary 3D shape. In an embodiment, the second carrier block 220 may comprise an arc-shaped convex surface 221 and an arc-shaped concave surface 222, which may be parallel to each other, as shown in FIG. 2A. To comply with ID specifications, the second carrier block 220 may be the same or similar to conventional antenna carriers used in electronic devices. The second carrier block 220 may generally have a different shape from the first carrier block 210. However, it is possible that the second carrier block 220 may have a same or similar shape with the first carrier block 210. For example, both carrier blocks may simply take the form of rectangular blocks. For another example, as shown in FIG. 2A, both carrier blocks may have a same length but different other parameters. In addition, the second carrier block 220 may be made of a same or different material, and manufactured using a same or different technique from the first carrier block 210.

The second carrier block 220 may be disposed at a position corresponding to the first carrier block 210. The second carrier block 220 may have any suitable position and/or orientation with respect to the first carrier block 210. For example, as shown in FIG. 2B, the second carrier block 220 may be aligned to cover the intermediate layers of the first carrier block 210, so that both the outside or external surfaces (e.g., the surfaces 213 and 221) and inside or internal surfaces (e.g., the surfaces 216 and 222) of the antenna carrier 200 may be effectively utilized. It should be noted that, since ID specifications may require one or more curved (e.g., rounded) surfaces on the antenna carrier to fit the smooth edges of electronic devices, the allowed antenna volume may not be a rectangular block. Within the confinement of the antenna volume, the positions of the carrier blocks may be arranged in a way such that the overall surface area available for routing radiators may be sufficient to incorporate all necessary frequency bands and/or to improve antenna performance.

The first carrier block 210 and the second carrier block 220 may be coupled using any suitable mechanisms. For example, they may comprise corresponding surface features on one or more surfaces to facilitate their mechanical coupling. As shown in FIG. 2A, two recessed holes on the carrier block 210 and two protruding cylindrical posts (or bosses) on the carrier block 220 may be used for coupling. The coupling of carrier blocks may occur before or after placement of radiators, and may be temporary or permanent. There may be air or other medium (e.g., stuffing materials, adhesives) in the space between the two coupled carrier blocks. While FIGS. 2A-2B show only two carrier blocks, it should be understood that, depending on application, the antenna carrier 200 may comprise more than two carrier blocks, wherein each carrier block may be coupled to at least one other carrier block. The descriptions above regarding the carrier block 210 and/or the carrier block 220 may be applicable to any other additional block.

Figure 3:
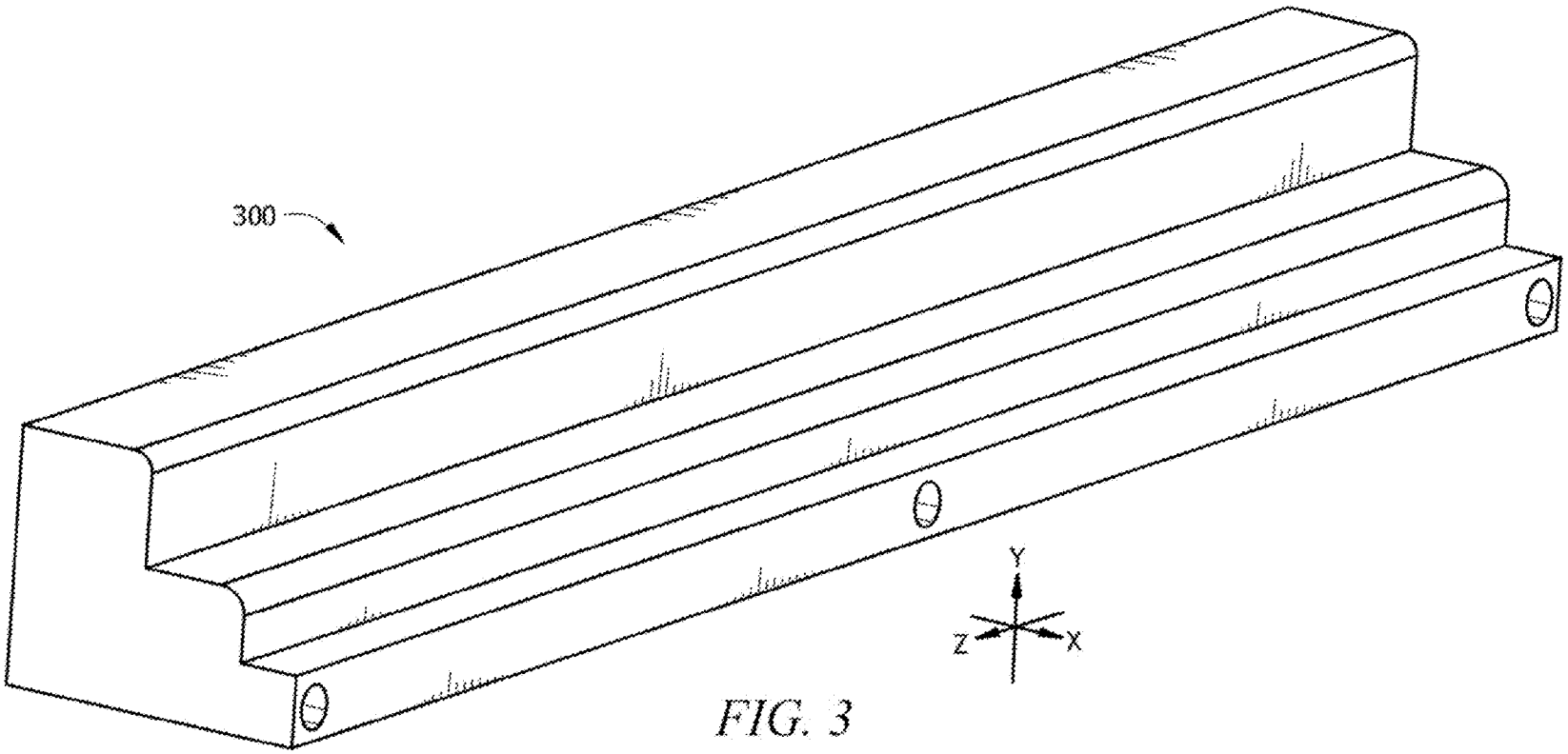
FIG. 3 is a perspective view of an embodiment of a carrier block.

Depending on application, an antenna carrier and its carrier blocks may have any suitable size or dimension. FIG. 3 shows a perspective view of an embodiment of a carrier block 300 with size specifications. For illustrative purposes, the carrier block 300 is configured to have an overall length of 60 mm, a bottom width of 8.8 mm, a top width of 4.0 mm, and a distance of 7.0 mm between the top and bottom faces. Since the carrier block 300 may be similar to the carrier block 210 in FIGS. 2A-2B, similar aspects will not be further described in the interest of clarity.

Figure 4:
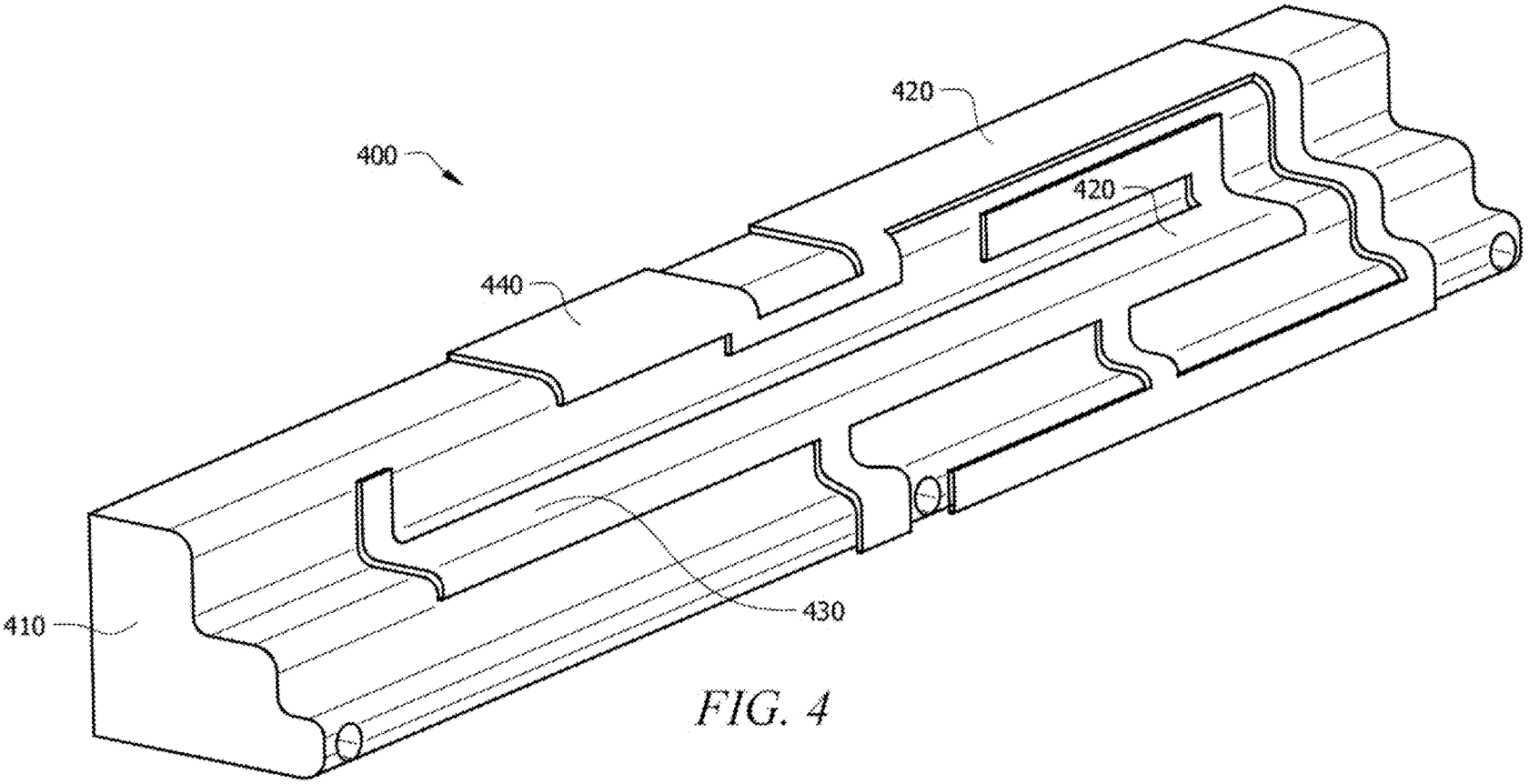
FIG. 4 is a perspective view of an embodiment of an antenna comprising a carrier block and a radiator.

As mentioned above, the carrier blocks may serve as a supporting substrate or platform for one or more antenna radiators. FIG. 4 is a perspective view of an embodiment of an antenna 400 comprising a carrier block 410 and a radiator 420. The carrier block 410 may be the same or similar to the carrier blocks described previously. The radiator 420 may comprise one or more radiator branches with different parameters (e.g., lengths), and each radiator branch may transmit and receive radio signals at a different frequency band. In an embodiment, the radiator 420 comprises a first radiator branch 430 and a second radiator branch 440, as shown in FIG. 4. The first radiator branch 430 and the second radiator branch 440 may be electrically connected and share a common feed line.

In use, the radiator 420 may be positioned on any part of the carrier block 410. For example, the radiator 420 may be positioned on a left surface, a right surface, a back surface, a top surface, a bottom surface, and/or an intermediate layer of the carrier block 410. One radiator branch of the radiator 420 (e.g., the radiator branch 430) may remain in one surface or may cross a plurality of faces. On the other hand, each surface may contain a plurality of radiator branches. If desired, one or more radiator branches may be routed (traced, or patterned) beyond the extent of carrier block 410. For example, part of a radiator branch on a carrier block may continue onto other surfaces of an electronic device such as a back cover, a battery cover, a housing cover (sometimes referred to as a B cover), any other surface, and any combination thereof. Further, if desired, the extended or continued portion of the radiator branch on other surface(s) may in turn be connected to one or more other carrier blocks. In an embodiment, the radiator branch 430 may be routed in any geometry (or pattern) on the carrier block 410. The geometry of the radiator branch 430 may have any suitable parameters such as length, width, thickness, etc., which may vary or remain the same along the length of the radiator branch 430. Through controlling the parameters of the radiator branch 430, any frequency band may be implemented. Depending on application, radiator branches corresponding to certain frequency bands may be placed in specific regions (e.g., center of an intermediate layer) of the surface of the carrier block 410, so that the performance of the antenna may be optimized for certain use cases.

The radiator 420 may be made of any electrical conductor. Suitable structural materials for the radiator 420 may include, but are not limited to, copper, silver, aluminum, gold, chrome, nickel, zinc, platinum, any other suitable conductors, and any combination thereof. The radiator 420 may be routed (placed, or fixed) on the carrier block 410 via any suitable technique. Possible fabrication techniques of the radiator 420 may include, but are not limited to, laser direct structuring (LDS), stamped metal, flexible circuits (flex), any other suitable technique, or any combination thereof. The radiator 420 may be routed after the manufacturing of the carrier block 410 (after process), or may be routed during the formation of the carrier block 410. In practice, a portion or all of the radiator 420 may be protruding structures on or above the outside surface of the carrier block 410. Alternatively, a portion or all of the radiator 420 may be etched into the carrier block 410.

Figure 5A:
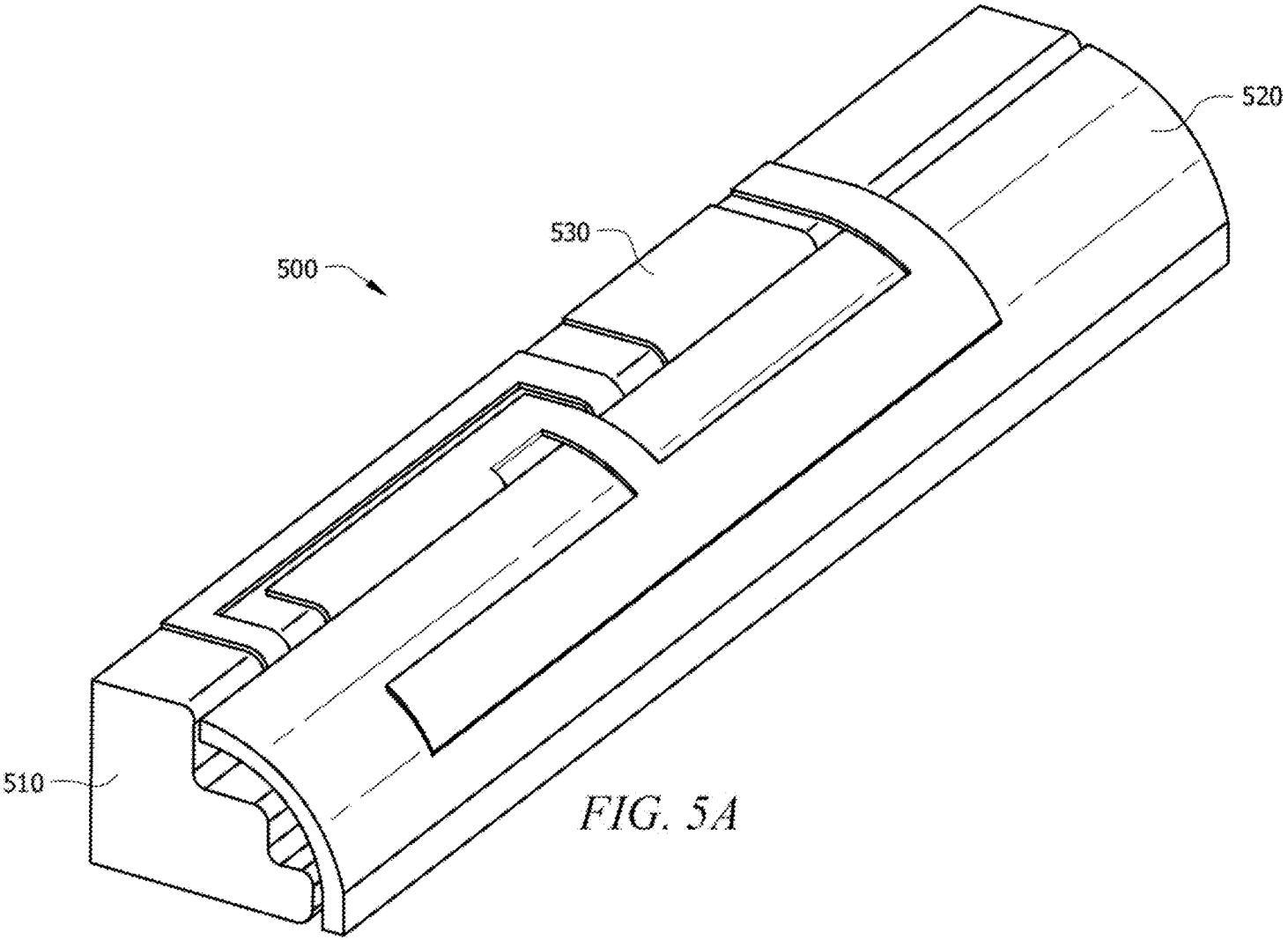
FIGS. 5A-5C are perspective views of an embodiment of an antenna comprising a first carrier block, a second carrier block, and a radiator.
Figure 5B:
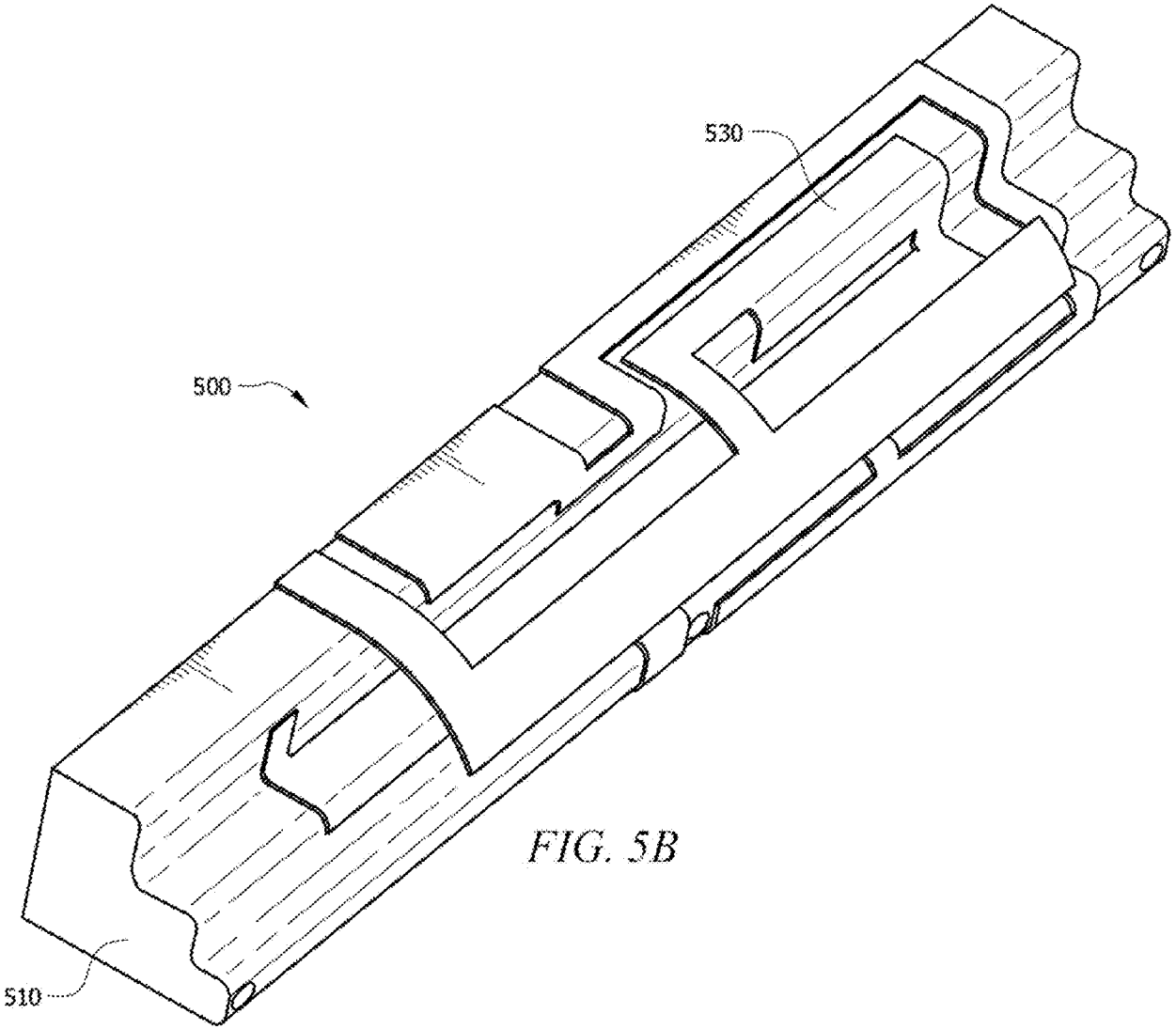
Figure 5C:
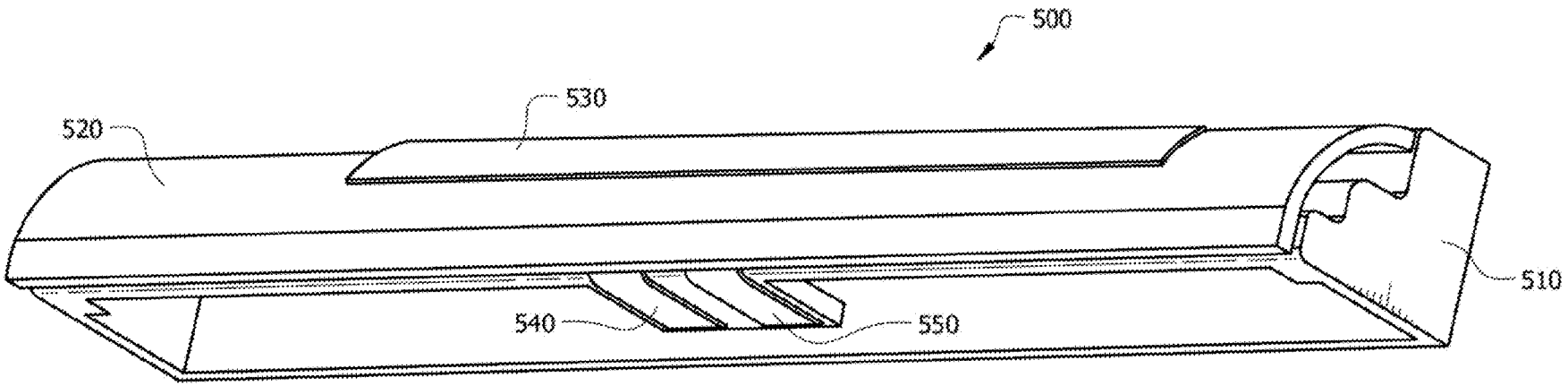

FIGS. 5A-5C are perspective views of an embodiment of an antenna 500, which may comprise a first carrier block 510, a second carrier block 520, and a radiator 530. The first carrier block 510 (or the second carrier block 520) may be the same or similar to aforementioned carrier blocks such as the first carrier block 210 in FIG. 2. The radiator 530 may be attached to the first carrier block 510 and the second carrier block 520, as shown in FIG. 5A. For example, a first portion of the radiator 530 may be routed on the first carrier block 510 and a second portion of the radiator 530 may be routed on the second carrier block 520 as shown. One or more radiator branches on each block may have the same or different geometries. By utilizing a plurality of surfaces such as the intermediate layers on the first carrier block 510, the total surface area available for routing the radiator 530 may be larger compared to a conventional antenna carrier (e.g., the antenna carrier 130 in FIG. 1). Regarding the antenna carrier as a whole including the first carrier block 510 and the second carrier block 520, an inside (or internal) surface of the antenna carrier may be utilized in addition to an outside (or external) surface utilized by conventional antennas.

As shown in FIG. 5C, the radiator 530 may be connected to a feed line through a first connection end 540, and/or a ground plane through a second connection end 550. In use, different radiator branches may have separate feed lines (or feeder). Alternatively, a portion or all of the radiator branches may share a common feed line. Depending on whether the antenna 500 is balanced or unbalanced, a ground plane (typically located on a printed circuit board (PCB)) may or may not be needed as an electrical ground. In addition, one or more radiator branches on different carrier blocks may be electrically connected. Alternatively, in some embodiments, one or more radiator branches on one carrier block may be placed in vicinity of a feed line on another carrier block, thereby forming a capacitive coupling between the radiator branches and the feed line. Similar to a direct electrical contact, the capacitive coupling may also enable the radiator to transmit and receive radio signals in certain types of antennas (e.g., some monopole antennas).

Figure 6A:
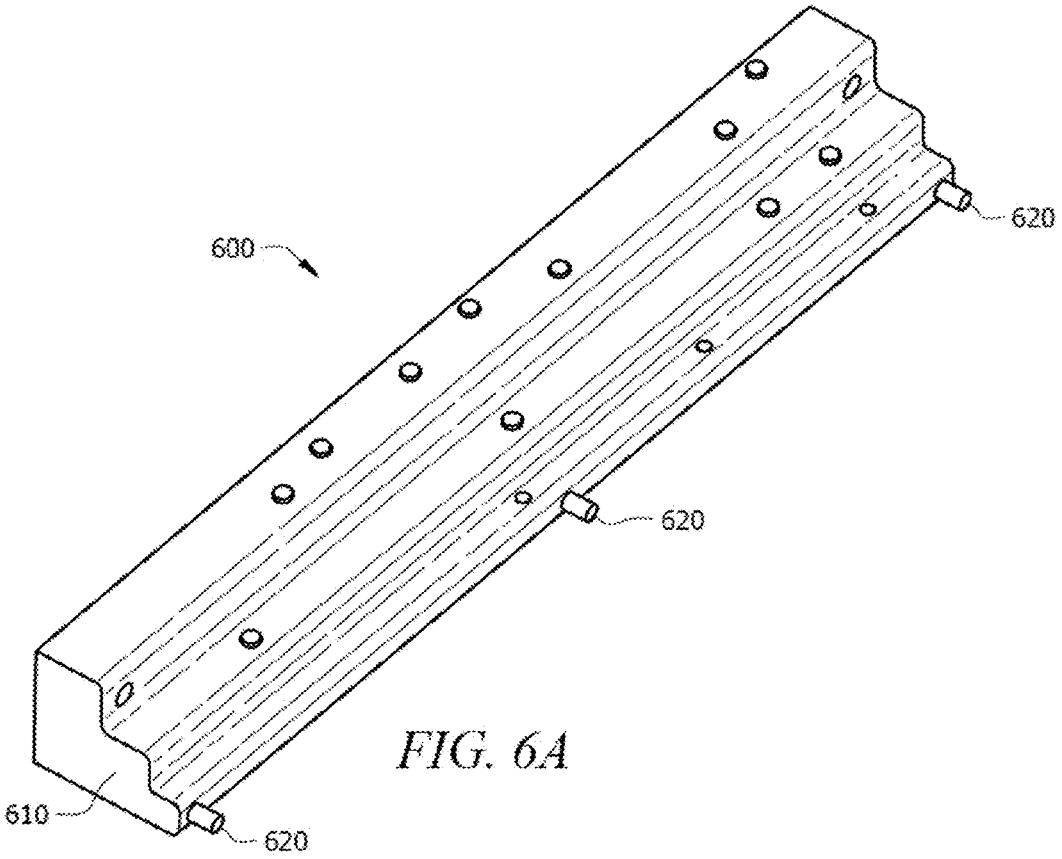
FIGS. 6A-6G are perspective views of one or more parts of an embodiment of an electrical coupling scheme via a spring finger.
Figure 6B:
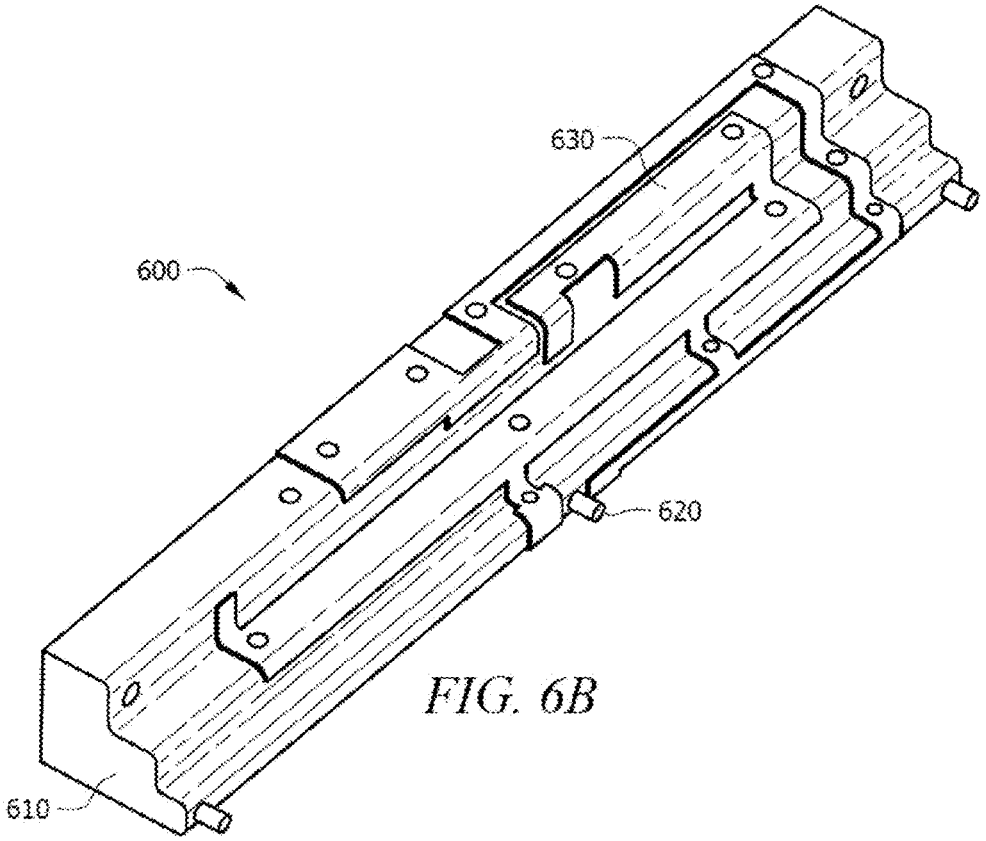
Figure 6C:
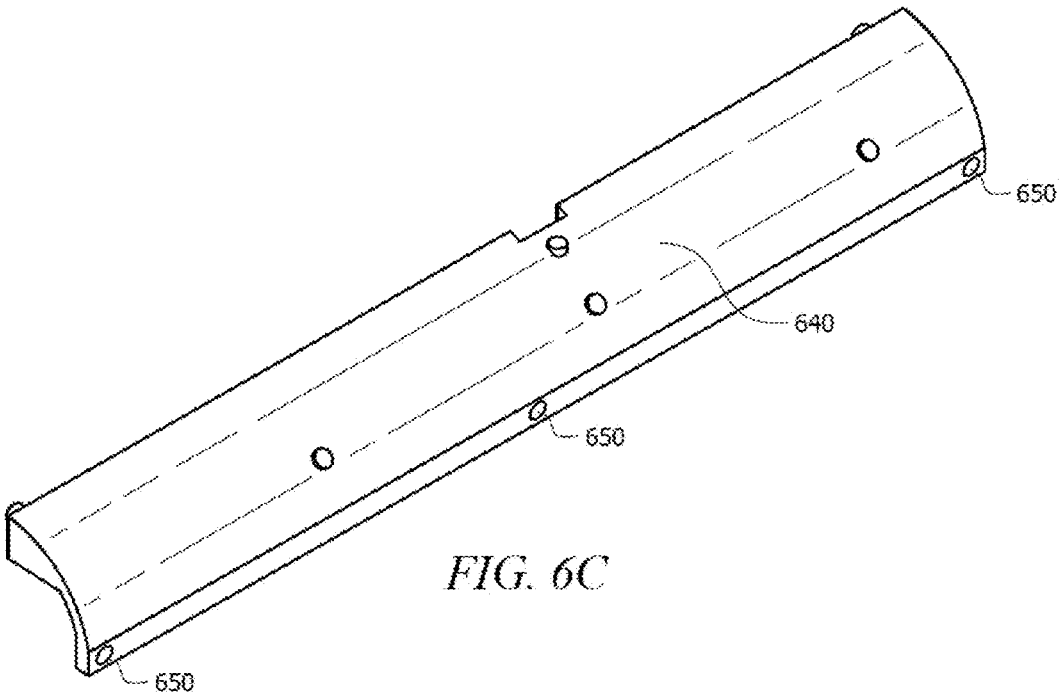
Figure 6D:
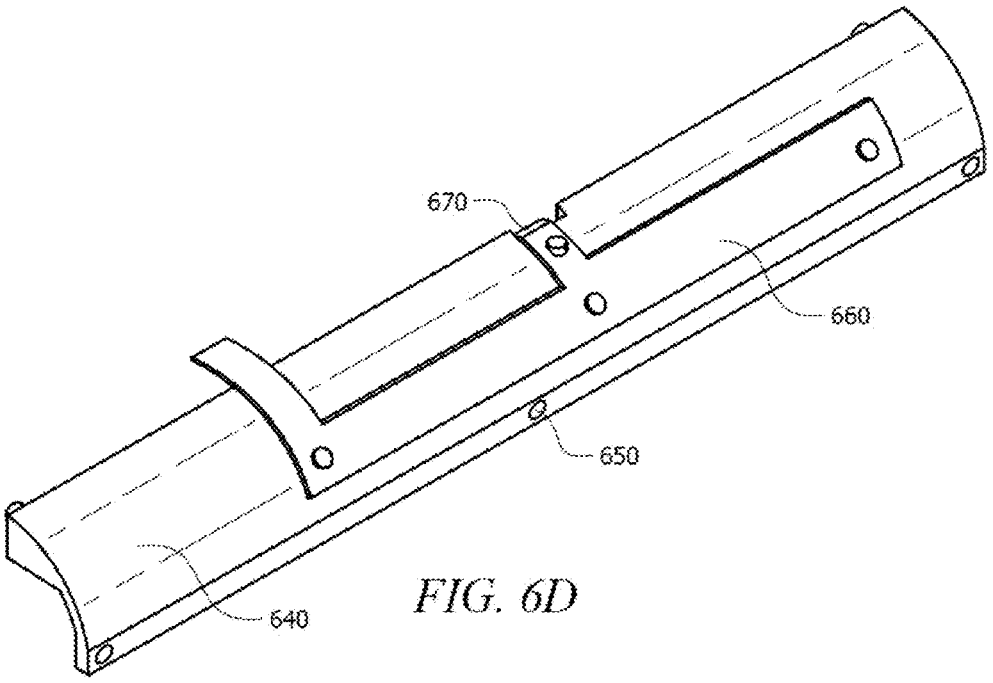
Figure 6E:
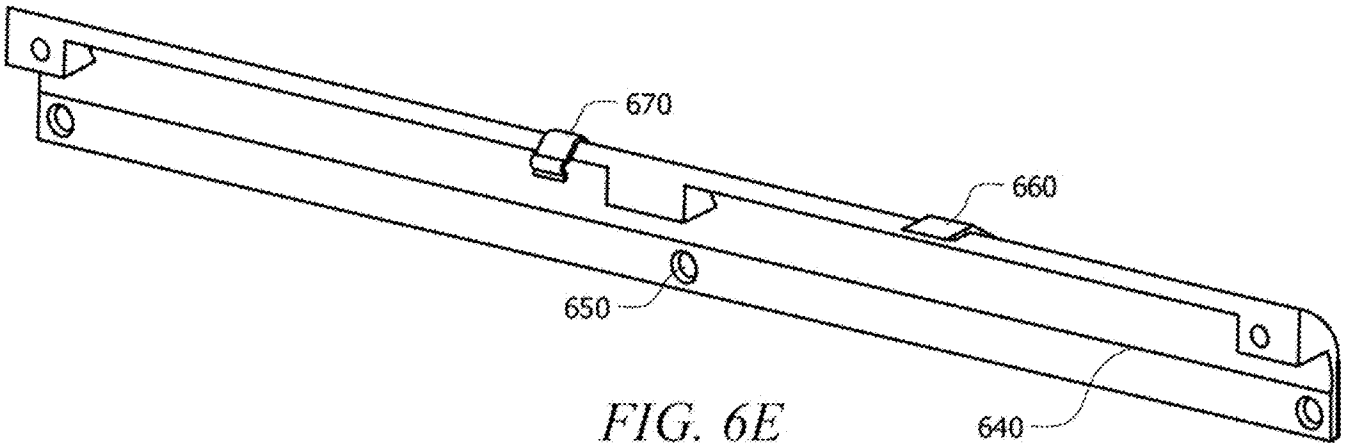
Figure 6F:
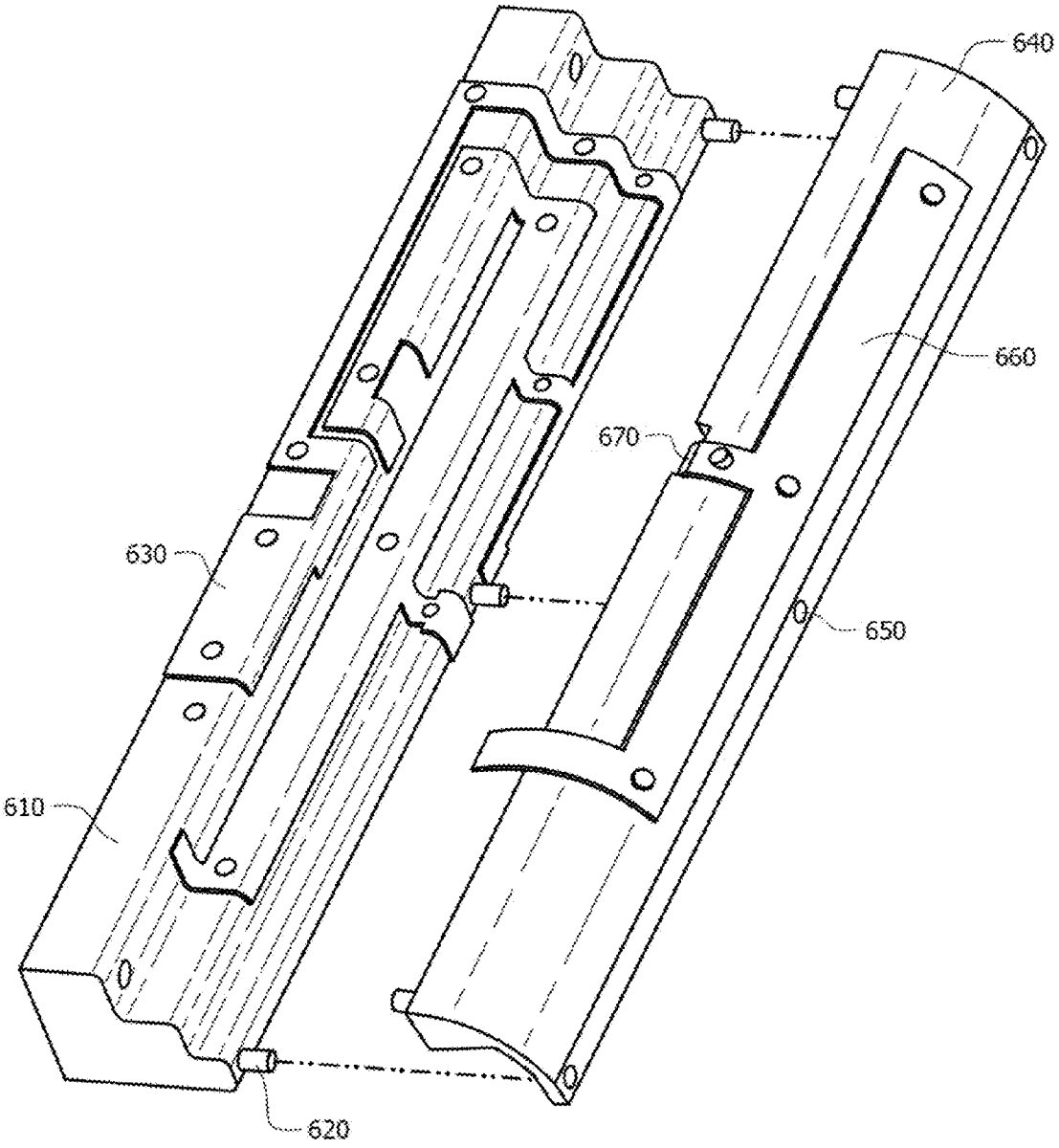
Figure 6G:
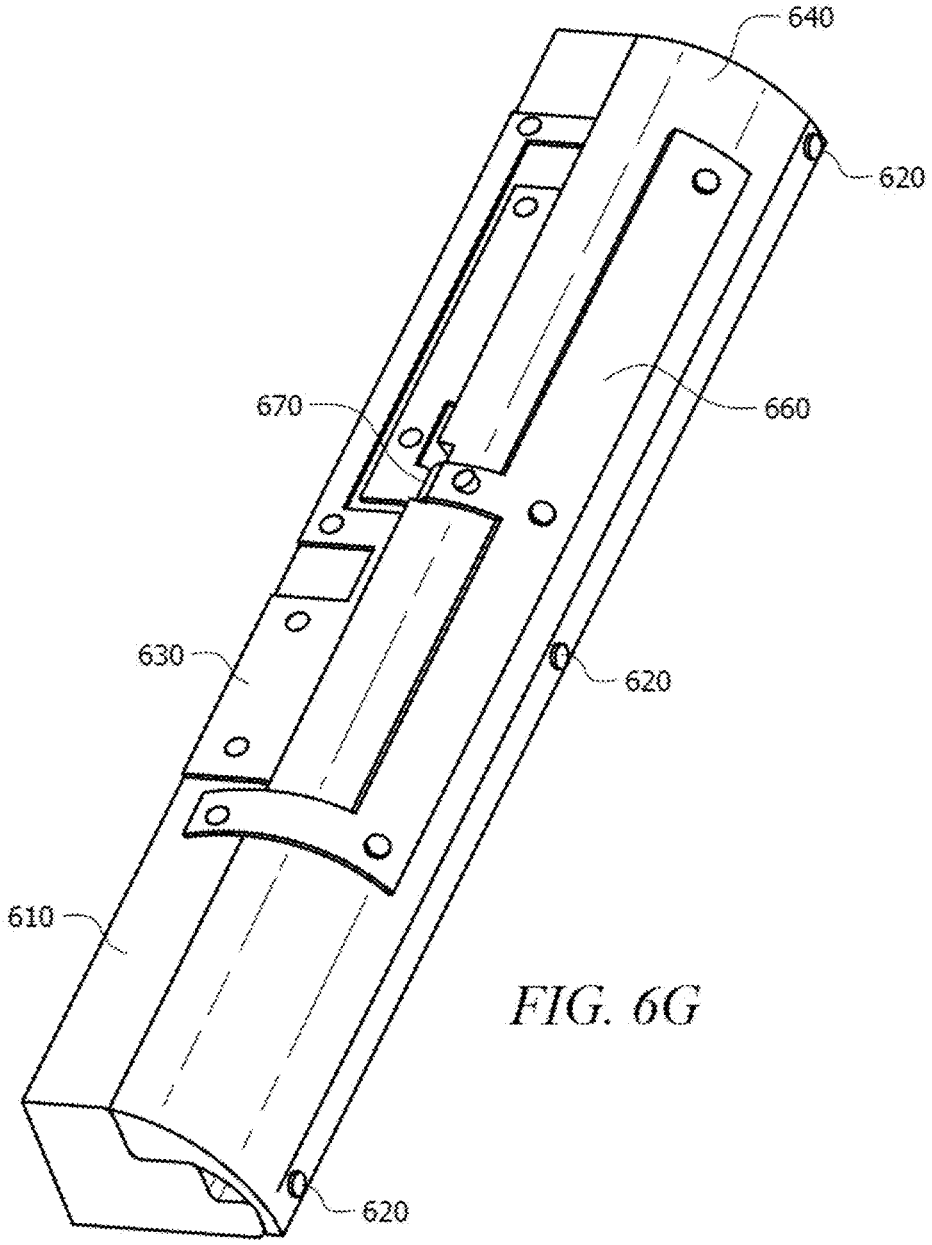

As mentioned above, an antenna carrier may comprise a number of carrier blocks, which may be coupled (or connected) mechanically and/or electrically. The following descriptions with respect to FIGS. 6-8 offer a more detailed understanding of various embodiments of mechanical and/or electrical coupling of two carrier blocks. In these figures, various antenna components such as an antenna carrier (including a plurality of carrier blocks) and a plurality of radiators may be the same or similar to the corresponding components described in previous figures, thus the similar aspects of these components will not be further described in the interest of clarity. FIGS. 6A-6G are perspective views of one or more parts of an embodiment of an electrical coupling scheme via a spring finger. As shown in FIG. 6A, a first carrier block 610 may comprise surface features such as a number of protruding cylindrical posts (or studs) 620 on a surface to facilitate mechanical coupling. As shown in FIG. 6B, the first carrier block 610 may support a first radiator 630, which may comprise a plurality of radiator branches. Likewise, as shown in FIG. 6C, a second carrier block 640 may comprise surface features such as a number of holes 650 on a curved surface. Also, as shown in FIG. 6D, the second carrier block 640 may support a second radiator 660, which may comprise one or more radiator branches. Additionally, as shown in FIG. 6E, a spring finger 670 may be included as part of the second radiator 660, which may facilitate an electrical coupling between the first carrier block 610 and the second carrier block 640. During manufacturing of the antenna carrier, the first carrier block 610 and the second carrier block 640 may be assembled together, as shown in FIGS. 6F-6G.

In an embodiment, a process of heat staking (or thermal-plastic staking) may be used to realize mechanical coupling between the first carrier block 610 and the second carrier block 640. Heat staking may use deformation of components caused by heating to create an interference fit between two components that are made of, for example, plastics. In practice, the protruding cylindrical posts 620 may be first fit into the corresponding holes 650. Then, heat staking may be applied to the cylindrical posts 620 so that it may deform due to softening of plastic. The deformation may form a head structure, which may mechanically lock the first carrier block 610 and the second carrier block 640 together.

Depending on application, the first radiator 630 and the second radiator 660 may function at a same or different frequency bands. Further, if desired, these two radiators may be electrically connected via a contact made by the spring finger 670. Due to mechanical elasticity of the spring finger 670, the electrical contact may be secured without having any extra surface feature on the first carrier block 610. In use, any suitable 3D shape, size, material and fabrication technique may be employed to implement the spring finger 670, which may be attached to the second radiator 660 via any suitable technique such as soldering, conductive adhesives, etc. It should be noted that while FIGS. 6D-6G show only one spring finger, if desired, a plurality of spring fingers may be used to electrically connect the two carrier blocks. After electrical coupling, the first radiator 630 and the second radiator 660 may share a feed line and/or a ground plane. Alternatively, a radiator branch of the first radiator 630 and another radiator branch the second radiator 660 may be connected to form an extended radiator branch.

Figure 7A:
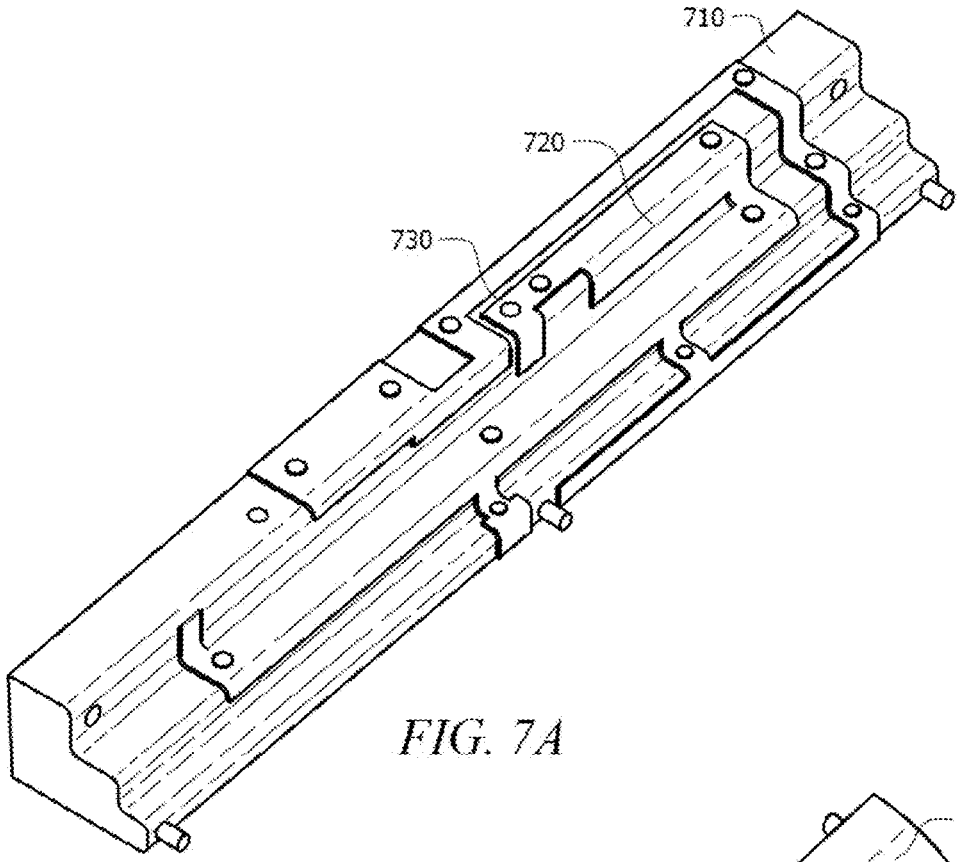
FIGS. 7A-7C are perspective views of one or more parts of an embodiment of an electrical coupling scheme via a screw.
Figure 7B:
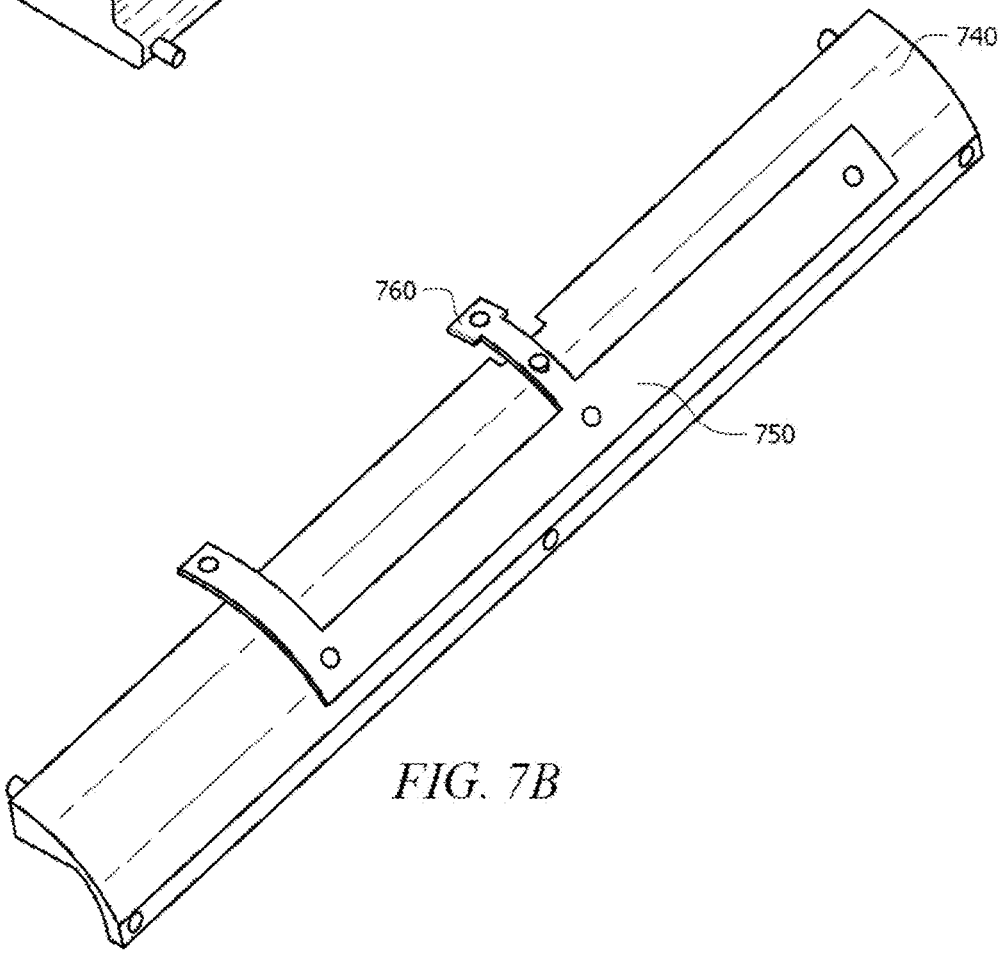
Figure 7C:
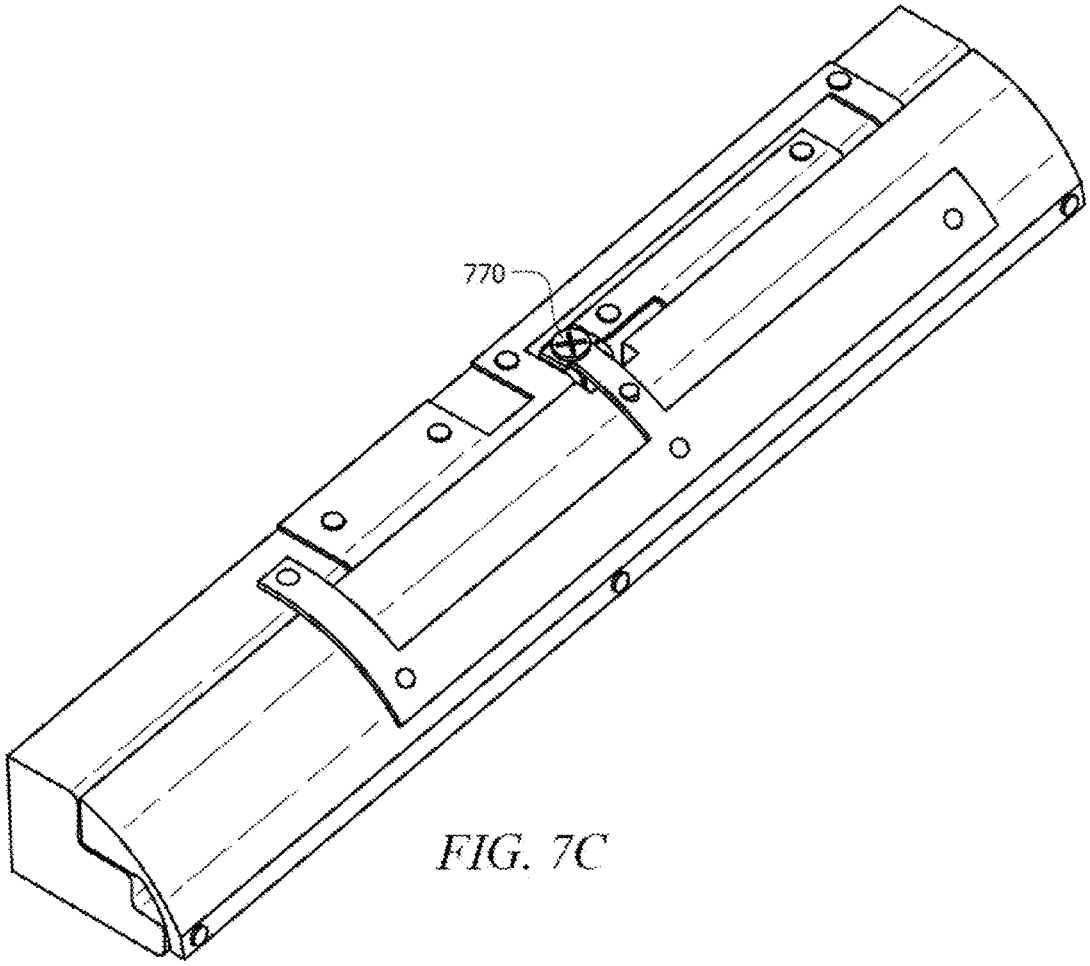

FIGS. 7A-7C are perspective views of one or more parts of an embodiment of an electrical coupling scheme via a screw. As shown in FIG. 7A, a first carrier block 710 may support a first radiator 720, and a recessed hole 730 may be created on a surface of the first carrier block 710. Further, the recessed hole 730 may pass through the first radiator 720 at a point. Likewise, as shown in FIG. 7B, a second carrier block 740 may support a second radiator 750, and a through hole 760 may penetrate through the second radiator 750 at a point. As shown in FIG. 7C, the first carrier block 710 and the second carrier block 740 may be aligned such that the recessed hole 730 may overlap with the through hole 760. To realize electrical coupling, a screw 770 made of a conductive material may be pressed or winded into the recessed hole 730 and the through hole 760, thereby making an electric contact between the first radiator 720 and the second radiator 750. In use, the screw 770 may have any suitable size and/or shape, and may be made from any suitable material by any suitable fabrication technique. In an embodiment, if no electrical coupling is needed between the two radiators, the screw 770 may even be made of an electrically insulating material (e.g., plastic) to enhance mechanical coupling between the first carrier block 710 and the second carrier block 740. While FIG. 7C shows only one screw, it should be understood that, if desired, a plurality of screws may be used to electrically couple the two radiators.

Figure 8A:
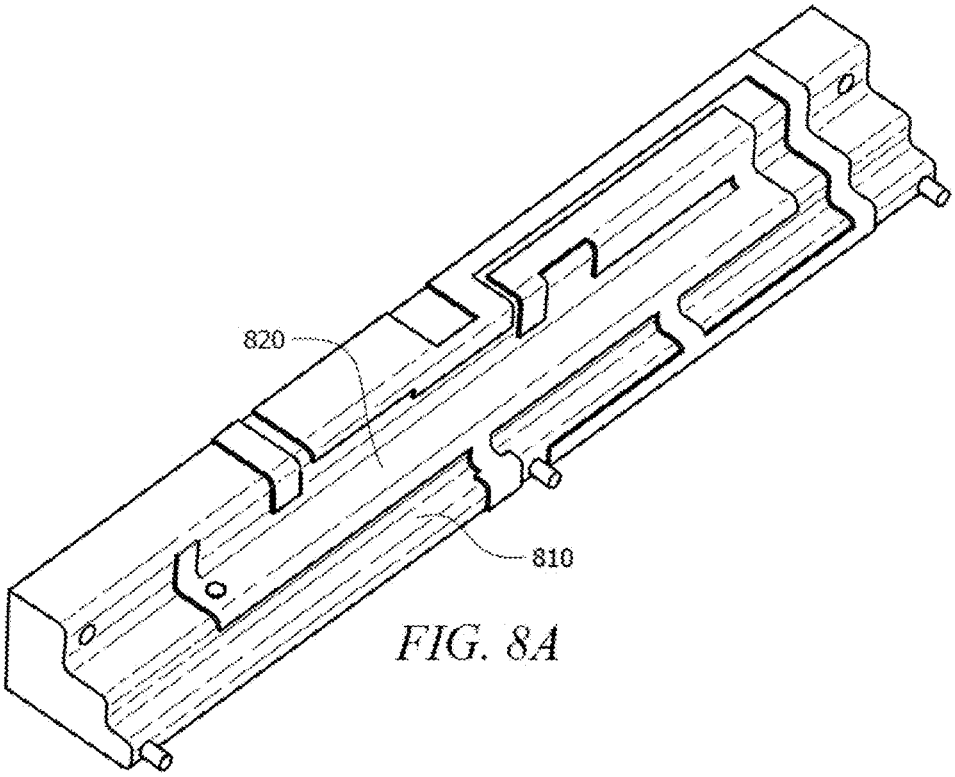
FIGS. 8A-8D are perspective views of one or more parts of an embodiment of an electrical coupling scheme via pogo pins.
Figure 8B:
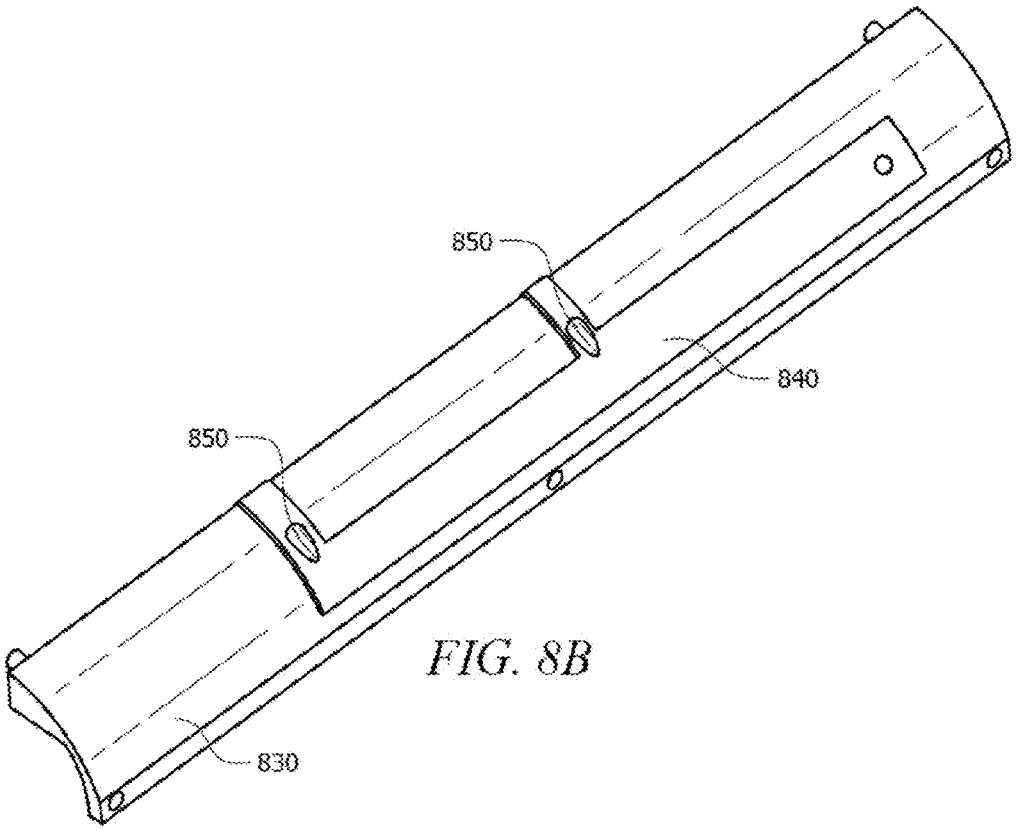
Figure 8C:
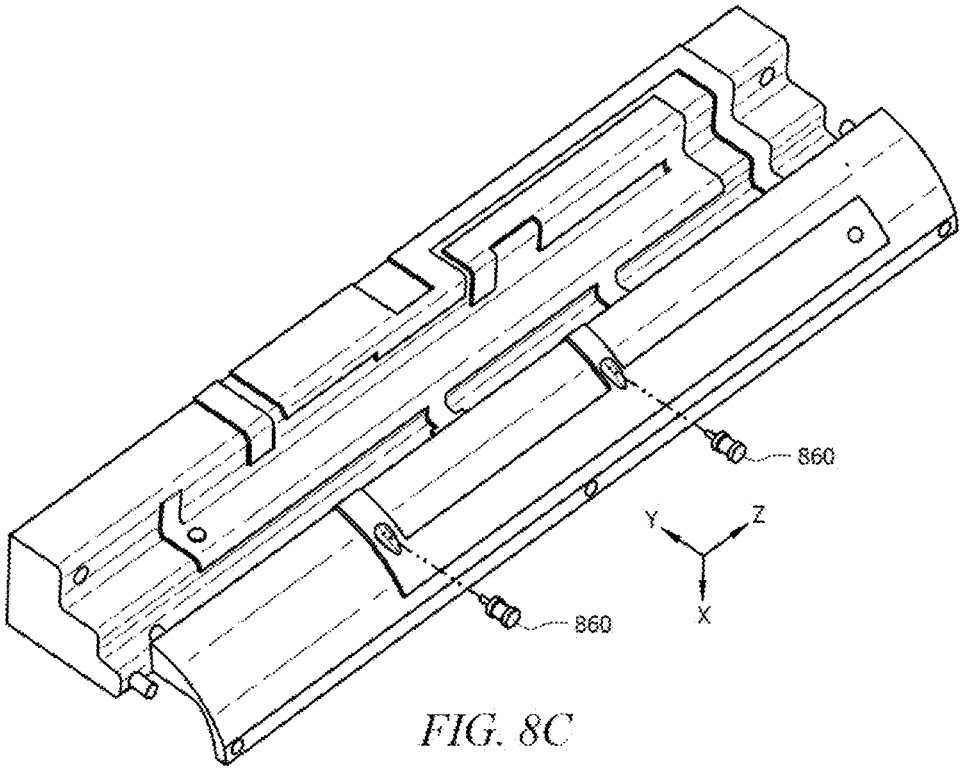
Figure 8D:
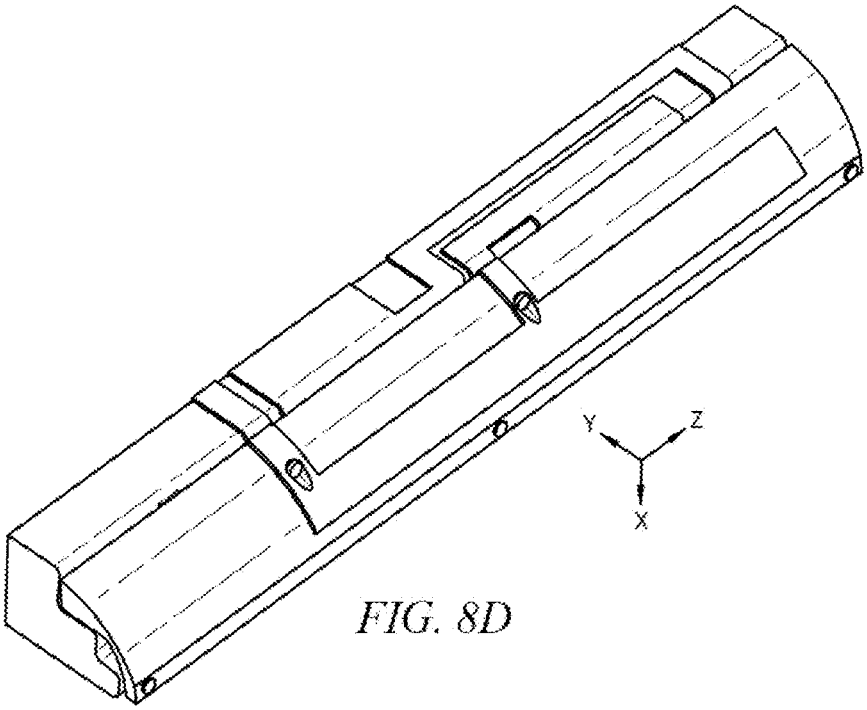

FIGS. 8A-8D are perspective views of one or more parts of an embodiment of an electrical coupling scheme via pogo pins. As shown in FIG. 8A, a first carrier block 810 may support a first radiator 820. Likewise, as shown in FIG. 8B, a second carrier block 830 may support a second radiator 840. Further, a number of through holes 850 may penetrate the second radiator 840 at certain positions. As shown in FIG. 8C, the first carrier block 810 and the second carrier block 820 may be positioned closely and aligned, and a number of pogo pins 860 equal to the number of through holes 850 may be used to realize electrical coupling. As shown in FIG. 8D, the pogo pins 860 made of a conductive material may be pressed into the through holes 850, and make contacts with both the first radiator 720 and the second radiator 750. The pogo pins 860 may have any suitable size and/or shape, and may be made from any suitable material by any suitable fabrication technique. For example, the pogo pins 860 may take the form of a slender cylinder containing two sharp, spring-loaded pins. Although FIGS. 8C-8D show two pogo pins, if desired, any number of pogo pins may be used to electrically connect the two radiators.

It should be noted herein that in addition to the coupling schemes discussed above with respect to FIGS. 6-8, any other suitable schemes may be used to realize mechanical and/or electrical coupling between a plurality of carrier blocks. In practice, a plurality of carrier blocks may be temporarily or permanently connected by a variety of physical and/or chemical bonding techniques, which may or may not introduce additional materials into the antenna structure. For example, adhesives (e.g., conductive paste, non-conductive glue, etc.) may be applied on corresponding surfaces of two carrier blocks to physically bond them together. For another example, techniques such as corona discharge and oxygen plasma, which may introduce no additional material, may be used to treat corresponding surfaces of two carrier blocks. Molecules on the corresponding surfaces may be activated, and a chemical bond may be formed between the two carrier blocks. In some embodiments, a combination of various techniques may be used to realize physical and/or chemical bonding of carrier blocks. When a plurality of carrier blocks are atomically attached to or coupled with one another, the coupled blocks may also be referred to as one complex carrier block.

In practice, a wide variety of antennas may be implemented using an embodiment of the disclosed antenna carrier structures. Possible antenna types may include, but are not limited to, dipole antenna (e.g., short dipole, half-wave dipole, folded dipole, broadband dipoles), monopole antenna, small loop antenna, rectangular microstrip (or patch) antenna, planar inverted-F antennas (PIFA), helical antenna, spiral antenna, slot antenna, cavity-backed slot antenna, inverted-F antenna (IFA), slotted waveguide antenna, near field communications (NFC) antenna, any other antenna, and any combination thereof. Further, if desired, a plurality of antennas may be placed in different parts of an electronic device to perform different functionalities. The plurality of antennas may be of a same or different types.

A radiator disclosed herein (e.g., the radiator 420) may be connected to a carrier or a carrier block (e.g., the carrier block 410). The connection between a radiator and a carrier block may be chemical or mechanical. For example, a radiator may be bonded to or attached to a carrier block via any available bonding technique known to those skilled in the art. For another example, a radiator and a carrier block may be connected to each other via one or more screws.

Using an embodiment of the disclosed antenna carrier arrangement, any useful wireless communication bands may be incorporated into one or more antennas of an electronic device. For example, possible communication frequency bands may include, but are not limited to, cellular telephone bands (e.g., 850 MHz, 900 MHz, 1800 MHz, and 1900 MHz), third generation (3G) data communication bands which is also referred to as Universal Mobile Telecommunications System (UMTS) (e.g., Band V, Band II, Band I, Band VIII), Long Term Evolution (LTE) bands (e.g., 700 MHz (Band XII, Band XIII, Band XVII), 800 MHz (Band V), 1700 MHz (Band IV), 1900 MHz (Band II), 2100 MHz and 2600 MHz (Band VII)), Wi-Fi (also referred to as Institute of Electrical and Electronics Engineers (IEEE) 802.11) bands (e.g., 2.4 GHz and 5.0 GHz), the Bluetooth band at 2.4 GHz, and the global positioning system (GPS) band at 1575 MHz. The disclosed antenna carrier arrangement may cover these frequency bands and/or other suitable frequency bands with proper configuration of antenna carrier blocks and radiator branches.

During implementation of an antenna, an antenna designer may construct prototype devices and test their performance under a variety of use cases such as Free Space (FS), Beside Head (BH) (Head Phantom Only), Beside Head Left Side (BHL) (Head Phantom Only), Beside Head Right Side (BHR) (Head Phantom Only), Beside Head and Hand Right Side (BHHR) (Head and Hand Phantom) and Hand Right (HR) (Hand Phantom Only). These use cases may be specified by wireless carriers to verify antenna performance in different ambient environments. In practical use of antennas, radiation energy from the antenna may be partially absorbed by objects such as a human head or hand. Additionally, the frequency bands of the antenna may be detuned by the object. Thus, testing of various use case may be useful steps before the antenna gets commercialized.

Figure 9A:
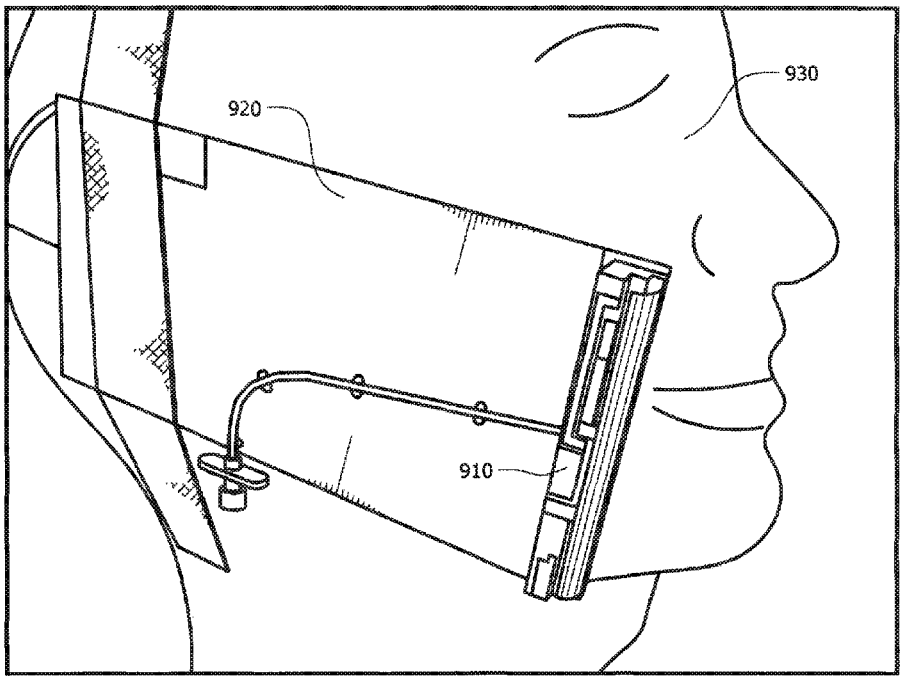
FIGS. 9A-9C are images of perspective views of a prototype antenna tested in a Beside Head Right Side (BHR) use case.
Figure 9B:
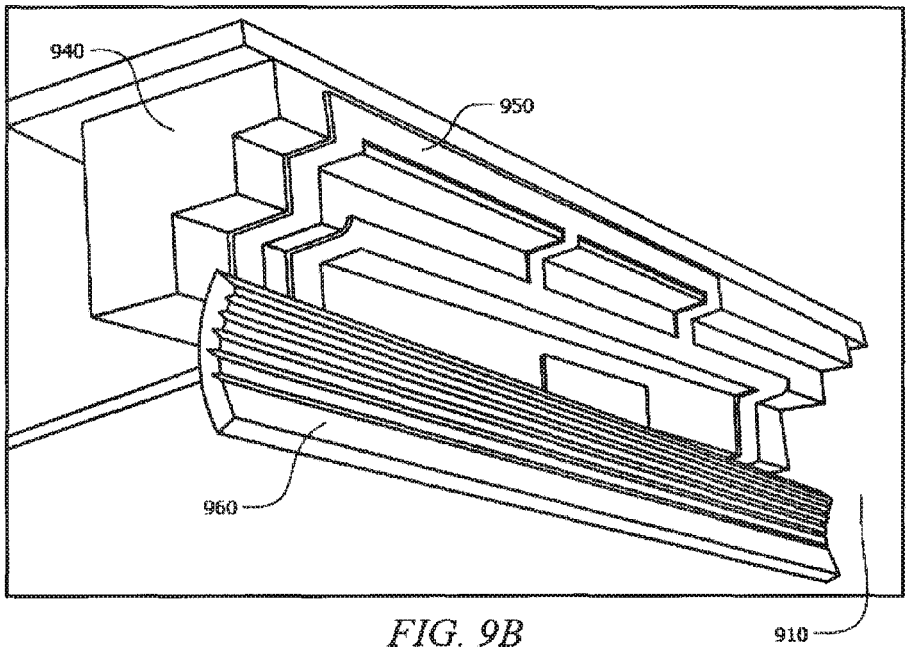
Figure 9C:
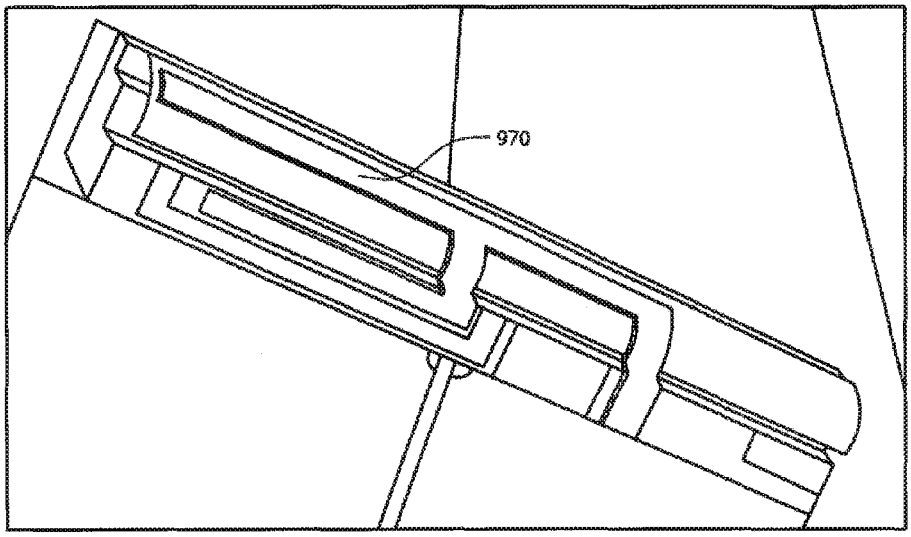

FIGS. 9A-9C are images of perspective views of a prototype antenna 910 tested in the BHR use case. As shown in FIG. 9A, the prototype antenna 910 is attached to a printed circuit board (PCB) 920, which is placed on the right side of a head phantom 930. This setup is configured to simulate an electronic communication device (e.g., a mobile phone) in an active conversation. FIGS. 9B and 9C show two close-up views of the antenna 910, which comprises a first carrier block 940 supporting a first radiator 950 and a second block 960 supporting a second radiator 970. The radiator 950 is routed on a plurality of surfaces of the first carrier block 940. As shown in FIG. 9B, the second carrier block 960 is connected to the first carrier block 940, but not fully aligned in an operating position (in other words, the antenna 910 is opened). Part of the radiator 950 resides on an inside surface of the antenna 910. As shown in FIG. 9C, the second carrier block 960 is fully aligned with respect to the first carrier block 940 (in other words, the antenna 910 is closed), and the second radiator 970 can be seen.

Figure 10A:
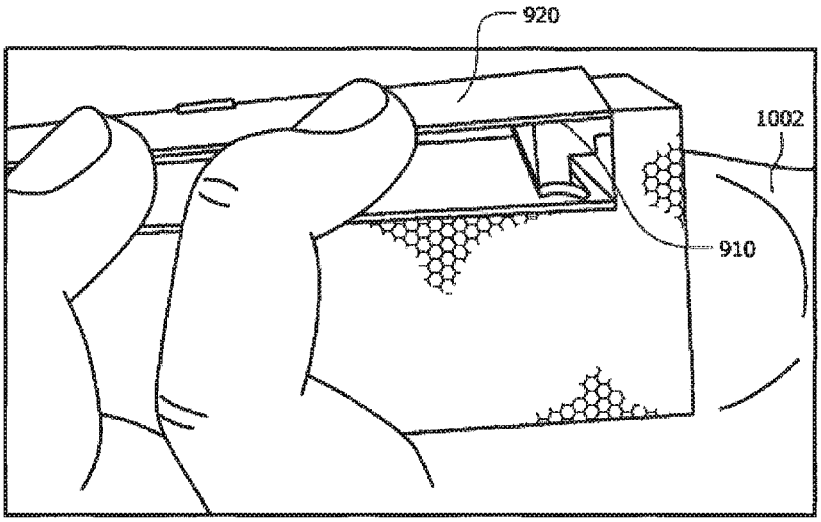
FIGS. 10A and 10B are images of the prototype antenna tested in a Hand Right (HR) use case.
Figure 10B:
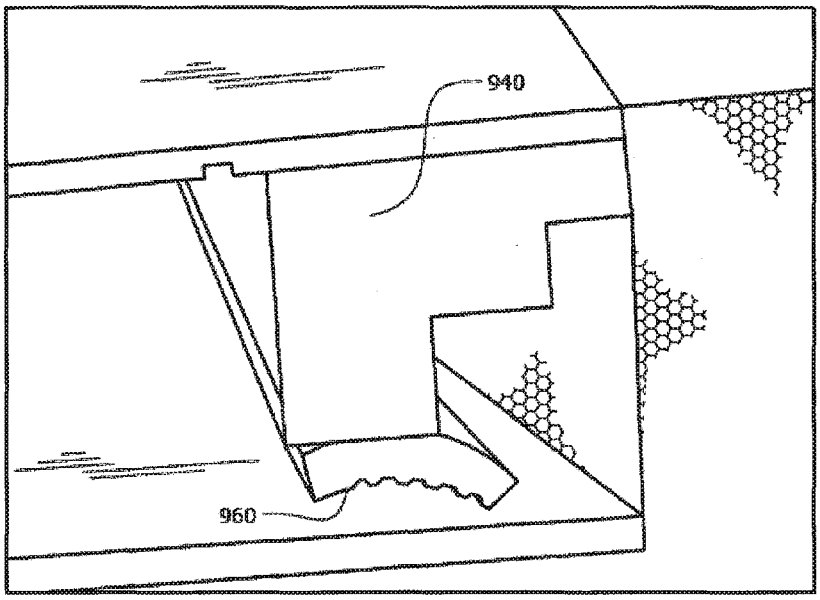

FIGS. 10A and 10B show two images of the prototype antenna 910 tested in an HR use case. As shown in FIG. 10A, the prototype antenna 910 is separated from a hand phantom 1002 by a foam spacer. This setup was configured to simulate an electronic device (e.g., a mobile phone) in a human hand. FIG. 10B shows a closed-up side view of the antenna 910 with the first carrier block 940 and the second carrier block 960 are situated underneath the PCB 920. Since the disclosed antenna carrier arrangement may allow the radiator to be routed not only on the outside surface of the antenna carrier, but also the inside surface of the antenna carrier, the number of frequency bands that can be incorporated may increase accordingly. Further, a radiator branch working at a specific frequency band may be placed in a specific region of the carrier surface, so that the antenna performance may be optimized for certain use cases. For example, if testing of the HR use case reveals that high frequency bands have better radiated performance when their corresponding radiator branches are further away from a hand phantom, these radiator branches may then be routed on an inside surface of the antenna carrier (e.g., an intermediate layer of the first carrier block 940). Accordingly, for a portable electronic device which may use high frequency bands (e.g., Wi-Fi at 5.0 GHz), the performance of its antenna may be improved in comparison to a conventional antenna which may only have radiator branches routed on the outside surface of the antenna carrier. Thus, the expanded surface area made available by the present disclosure may offer higher flexibility in the design of antennas, which may in turn lead to miniaturization of antenna volume and/or improvement of antenna performance.

Figure 11A:
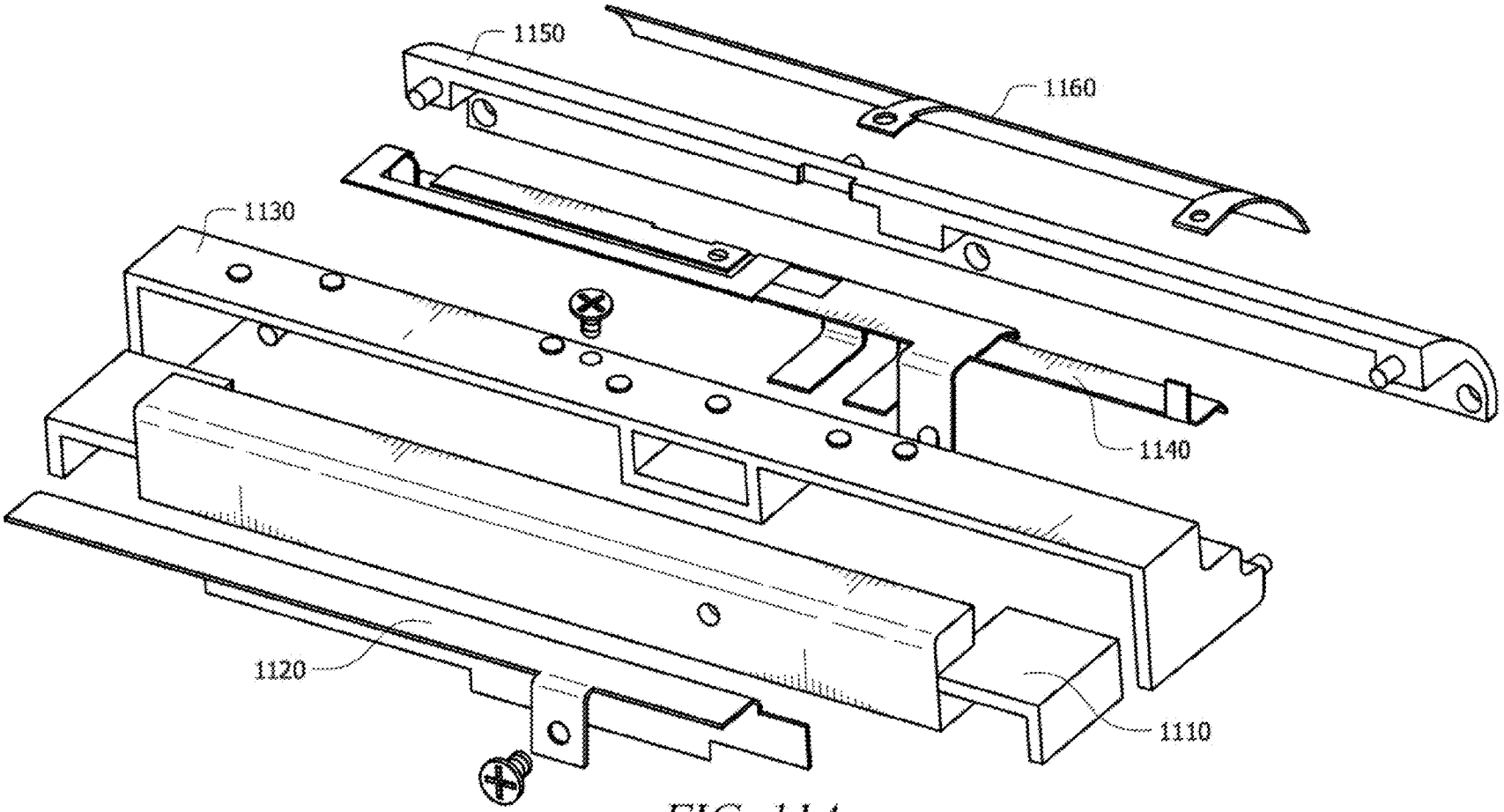
FIGS. 11A-11E are perspective views of one or more parts of an embodiment of an antenna.
Figure 11B:
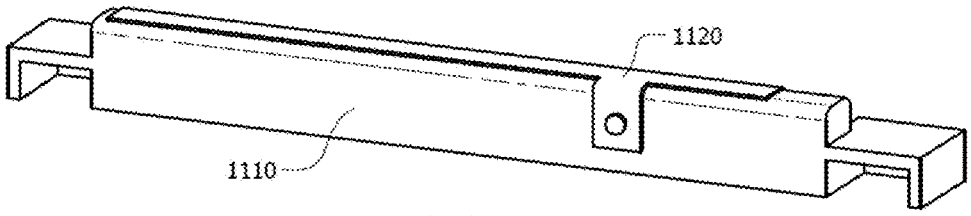
Figure 11C:
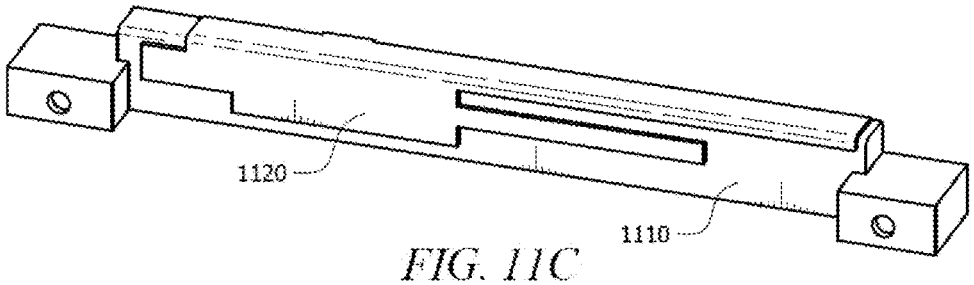

In practice, any number of carrier blocks and/or radiators may be used in the construction of an antenna. FIGS. 11A-11E illustrate perspective views of one or more parts of an embodiment of an antenna. As shown in FIG. 11A, an antenna may comprise a first carrier block 1110 supporting a first radiator 1120, a second carrier block 1130 supporting a second radiator 1140, and a third carrier block 1150 supporting a third radiator 1160. For illustration, the parts of the antenna are shown separately in FIG. 11A and at various stages of assembly in FIGS. 11B-11E. Each carrier block may have any suitable 3D shape and may be the same or similar to aforementioned carrier blocks. For example, the first carrier block 1110 may comprise two similar end sections which are different from a middle section. In an embodiment, the second carrier block 1130 may be the same or similar to the first carrier block 710 in FIG. 7A, and the third carrier block 1150 may be the same or similar to the second carrier block 740 in FIG. 7B. Likewise, each radiator of the antenna may have any suitable geometry and may be the same or similar to aforementioned radiators. Further, each radiator may reside on any surface region of its supporting carrier block. For example, as shown in FIGS. 11B and 11C, the first radiator 1120 may be routed on three surfaces of the middle section of the first carrier block 1110.

Figure 11D:
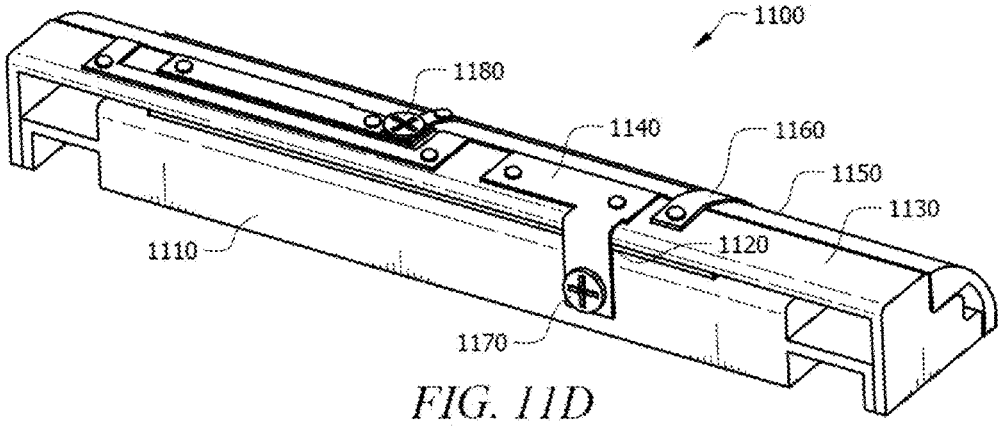
Figure 11E:
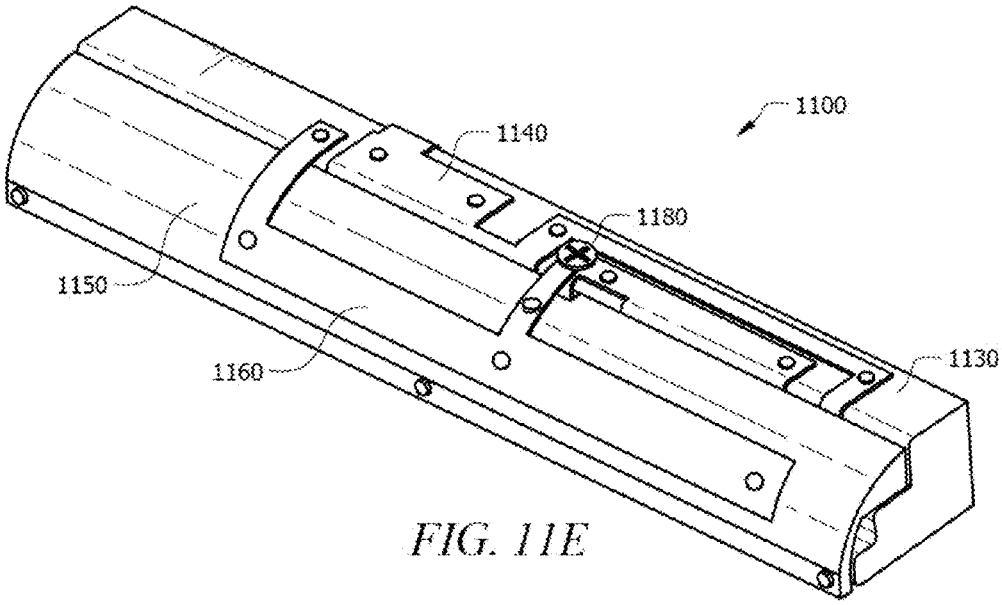

FIGS. 11D and 11E illustrate a fully assembled antenna 1100. In use, the carrier blocks and radiators of the antenna may be mechanically and/or electrically coupled together. For example, to realize electrical coupling of radiators, a first screw 1170 may be used to connect the first radiator 1120 and the second radiator 1140, as shown in FIG. 11D. Similarly, a second screw 1180 may be used to connect the second radiator 1140 and the third radiator 1160. In an embodiment, the first screw 1170 and second screw 1180 may be the same or similar to the screw 770 in FIG. 7C. In addition, the carrier blocks of the antenna may be disposed relative to each other such that a given antenna space may be effectively utilized. For example, as shown in FIGS. 11D and 11E, the lengths of the three carrier blocks may be aligned. The first carrier block 1110 may be placed under a hollow space created by the second carrier block 1130, whose multi-layered surfaces may be covered by the arc-shaped third carrier block 1150. In addition, one or more surface features may be incorporated into the carrier blocks to facilitate their mechanical coupling. For example, as shown in FIG. 11E, several plastic cylindrical posts and holes may secure the mechanical coupling between the second carrier block 1130 and the third carrier block 1150.

Figure 12A:
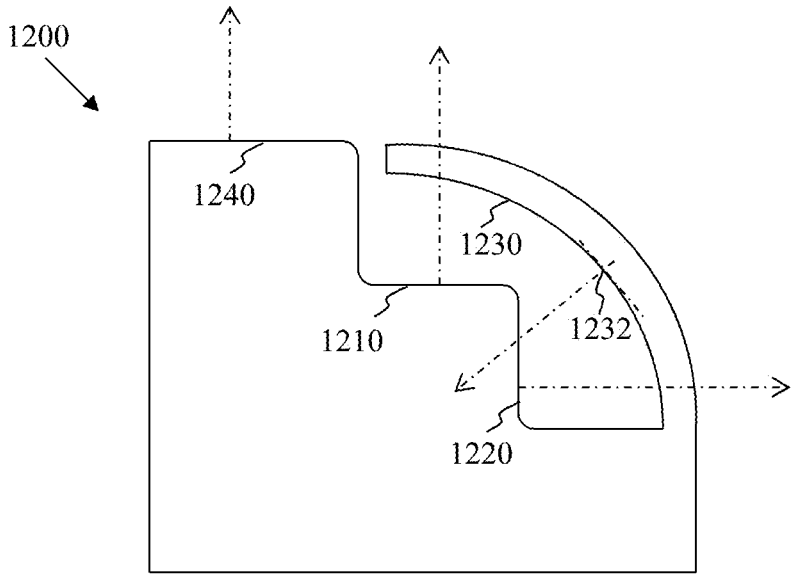
FIGS. 12A and 12B are side views of an embodiment of an antenna comprising a carrier and at least one radiator.

In an embodiment, many of the previously disclosed embodiments with multiple carrier blocks may be used to configure an antenna comprising a single carrier, wherein the carrier may have a complex shape. FIG. 12A illustrates a side view of an embodiment of an antenna carrier 1200, whose surfaces may comprise an internal part and an external part. Each of the internal part and external part may comprise one or more surfaces or planes, which may be flat or curved. For example, the internal part of the carrier 1200 comprises a horizontal surface 1210, a vertical surface 1220, a curved surface 1230, as well as other horizontal/vertical surfaces and rounded corners which are not marked by number. Terms horizontal and vertical are only relative terms used to help one understand FIG. 12 and not necessarily indicate a direction of the surface in operation. On the other hand, the external part of the carrier 1200 may comprise horizontal surface 1240 and other surfaces that are not numbered.

To differentiate the internal and external parts, one may draw an imaginary line from a point on a surface. In the internal part, an imaginary line drawing from any surface, with a certain angle (e.g., 70 to 110 degrees) to the surface, and going outward (i.e., into the air and not into the carrier) may intersect with another surface of the internal part. For example, a line drawn from surface 1210 and normal (i.e., 90 degrees) to surface 1210 may intersect with surface 1230. A line drawn from surface 1220 and normal (i.e., 90 degrees) to surface 1220 may intersect with surface 1230. For a curved surface (e.g., surface 1230 and rounded corners), an imaginary line drawn from the surface may be normal to a tangent line of the curved surface at the point where the imaginary line is drawn. For example, a line drawn from surface 1230 at point 1232 may be perpendicular to a tangent line of surface 1230. On the other hand, in the exterior part of the antenna carrier 1200, an imaginary line drawing from any surface, with a certain angle (e.g., 70 to 110 degrees) to the surface, and going outward may not intersect with any other surface of the carrier. For example, a line drawing from surface 1240 and normal to surface 1240 may not intersect any other surface. Thus, an internal part may be defined as an area on a surface of a carrier in which an imaginary line extending from any point in the area and normal to the area intersects another portion of the surface of the carrier. Further, an external part may be defined as an area on a surface of a carrier that is not an internal part. An alternative definition of external part is an area on a surface of a carrier in which an imaginary line extending from any point in the area and normal to the area does not intersect another portion of the surface of the carrier.

Figure 12B:
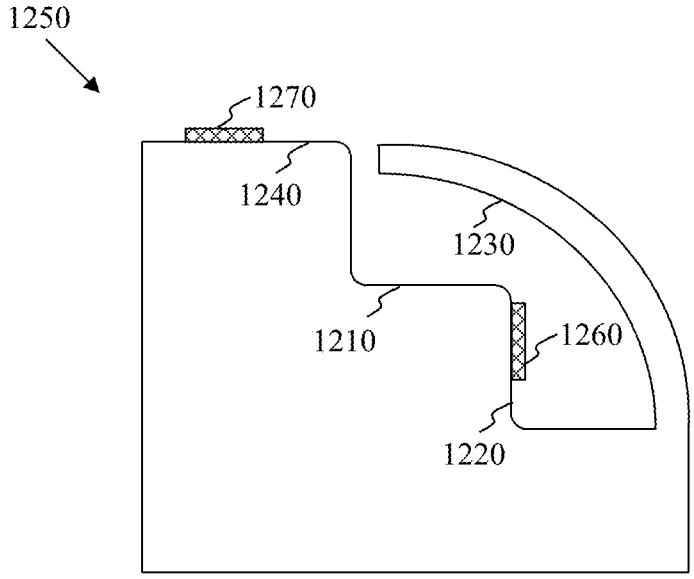

FIG. 12B is a side view of an embodiment of an antenna 1250 comprising a carrier (e.g., the carrier 1200) and at least one radiator. Some or all of the at least one radiator may comprise a plurality of radiator branches, each working in a different frequency band. In an embodiment, at least part of the radiator(s) may be patterned in an internal part of the carrier. For example, part or all of a radiator branch 1250 may be traced on surface 1220. Other surfaces of the internal part may also be configured to support radiator branch(es). In addition, an external part of the carrier may also be configured to support radiator branch(es). For example, part or all of a radiator branch 1270 may be traced on surface 1240. One skilled in the art would recognize that the antenna 1250 may be designed and used similarly to previously described antennas within principles of the present disclosure, thus other aspects of this single carrier will not be further described in the interest of conciseness.

In the antenna 1250, the carrier may have a complex design as it comprises the internal and external parts. Any suitable technique may be used to fabricate the carrier and trace the at least one radiator. Applicable techniques described above may be used in fabrication. With development of fabrication technologies, other techniques may also be used to realize the disclosed antenna design. As described previously, multiple radiator blocks may be attached or coupled together after radiator(s) have been pattern on them. Thus, the carrier of the antenna 1250 may be the result of attaching multiple carrier blocks together.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . . , 95 percent, 96 percent, 97 percent, 98 percent, 99 percent, or 100 percent. Moreover, any numerical range defined by two R numbers as defined in the above is also specifically disclosed. The use of the term about means±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. An antenna comprising:

a plurality of carrier blocks, wherein each carrier block is in direct physical contact with at least one other carrier block; and one or more radiators, wherein each of the one or more radiators is connected to at least one of the plurality of carrier blocks, and wherein at least one radiator of the one or more radiators is non-planar.

2. The antenna of claim 1, wherein at least one of the one or more radiators comprises a plurality of radiator branches, and wherein each radiator branch is configured to operate within a different frequency band.

3. An antenna comprising:

a plurality of carrier blocks, wherein each carrier block is coupled to at least one other carrier block; and one or more radiators, wherein each of the one or more radiators is connected to at least one of the plurality of carrier blocks, wherein at least one of the one or more radiators comprises a plurality of radiator branches, and wherein each radiator branch is configured to operate within a different frequency band, and wherein at least part of a first radiator of the one or more radiators is connected at least two surfaces of a first carrier block of the plurality of carrier blocks, and wherein at least part of a second radiator of the one or more radiators is connected to a second carrier block of the plurality of carrier blocks.

4. The antenna of claim 3, wherein at least one of the one or more radiators is electrically coupled with another of the one or more radiators.

5. The antenna of claim 4, wherein the first carrier block comprises a plurality of first surfaces, and wherein the second carrier block comprises a plurality of second surfaces, and wherein at least one of the plurality of first surfaces and the plurality of second surfaces is configured to pattern a radiator of the plurality of radiator branches.

6. The antenna of claim 5, wherein the first and second radiators are configured to operate within different frequency bands.

7. The antenna of claim 6, wherein the first carrier block comprises:

a first surface;

a second surface opposite the first surface and with a surface area different from the first surface;

a third surface connecting the first and second surfaces; and an intermediate layer opposite the third surface and connecting the first and second surfaces, wherein the intermediate layer comprises a plurality of surfaces configured in a stair-stepped pattern.

8. The antenna of claim 7, wherein the first radiator is attached to the intermediate layer.

9. The antenna of claim 8, wherein the second carrier block comprises a convex rounded surface and a concave rounded surface opposite the convex rounded surface, and wherein the second radiator is attached to the convex rounded surface.

10. The antenna of claim 9, wherein the first and second radiators are electrically coupled via a spring finger, a screw, a pogo pin, or any combination thereof.

11. The antenna of claim 10, wherein the first and second carrier blocks are coupled via heat staking of a plastic post.

12. The antenna of claim 9, wherein the first and second carrier blocks are aligned in a parallel direction, and wherein a length of the first carrier block is the same or similar to a length of the second carrier block.

13. The antenna of claim 4, wherein the first carrier block comprises a plurality of planar surfaces, wherein the second carrier block comprises a plurality of planar surfaces, wherein the second carrier block is aligned in a position relative to the first carrier block, wherein the one or more radiators further includes a third radiator, wherein the plurality of carrier blocks further includes a third carrier block, wherein at least part of the third radiator is connected to the third carrier block, wherein the third carrier block comprises a plurality of curved surfaces, wherein the third carrier block is aligned in a position relative to the second carrier block, and wherein the first, second and third radiators are electrically coupled and work at different frequency bands.

14. The antenna of claim 13, wherein the first, second and third radiators are electrically coupled via a spring finger, a screw, a pogo pin, or any combination thereof.

15. The antenna of claim 4, wherein the electrical coupling is achieved via a spring finger, a screw, a pogo pin, or any combination thereof.

16. The antenna of claim 4, wherein the carrier blocks are coupled physically, chemically, or both.

17. The antenna of claim 16, wherein the carrier blocks are coupled mechanically.

18. The antenna of claim 4, wherein the electrical coupling is capacitive coupling.

19. An antenna comprising:

a plurality of carrier blocks, wherein each carrier block is coupled to at least one other carrier block; and one or more radiators, wherein each of the one or more radiators is connected to at least one of the plurality of carrier blocks, wherein the one or more radiators arc configured to connect to at least two of the plurality of carrier blocks, and wherein at least one radiator of the one or more radiators is non-planar.

20. The antenna of claim 19, wherein a radiator of the one or more radiators is connected to a first carrier block and a second carrier block of the plurality of carrier blocks, wherein the radiator comprises a plurality of radiator branches, and wherein each radiator branch is configured to operate within a different frequency band.

21. An antenna comprising:

a plurality of antenna carriers, wherein each antenna carrier is directly coupled to at least one other antenna carrier physically, chemically, or both; and at least one radiator connected to at least one of the plurality of antenna carriers, wherein the at least one radiator is non-planar.

22. The antenna of claim 21, wherein the at least one radiator comprises a plurality of radiator branches, and wherein each radiator branch works at a different frequency band.

23. An antenna comprising:

a plurality of antenna carriers wherein each antenna carrier is coupled to at least one other antenna carrier physically, chemically, or both; and at least one radiator connected to at least one of the plurality of antenna carriers, wherein the at least one radiator comprises a plurality of radiator branches, wherein each radiator branch works at a different frequency band;

a first radiator connected to a first antenna carrier of the plurality of antenna carriers, wherein the first antenna carrier has a first surface and a second surface, wherein the first radiator is connected to the first surface and the second surface; and a second radiator connected to a second antenna carrier of the plurality of antenna carriers, wherein the first and second radiators are electrically coupled, and wherein the first and second antenna carriers are mechanically coupled.

24. An electronic communication device comprising:

an antenna comprising:

a plurality of carrier blocks, wherein each carrier block is in direct physical contact with at least one other carrier block; and at least one radiator, wherein each of the at least one radiator is connected to at least one of the plurality of carrier blocks, wherein at least one radiator is non-planar, and wherein the at least one radiator is connected to a plurality of surfaces of the at least one of the plurality of carrier blocks.

25. The electronic communication device of claim 24, wherein the at least one radiator includes a radiator, wherein the radiator comprises a plurality of radiator branches, and wherein each radiator branch is configured to operate within a different frequency band.

26. An electronic communication device comprising:

an antenna comprising;

a plurality of carrier blocks, wherein each carrier block is coupled to at least one other carrier block; and at least one radiator, wherein each of the at least one radiator is connected to at least one of the plurality of carrier blocks, wherein the at least one radiator is non-planar, wherein the at least one radiator includes a first radiator and a second radiator, wherein the plurality of carrier blocks includes a first carrier block and a second carrier block, wherein at least part of the first radiator is connected to the first carrier block, and wherein at least part of the second radiator is connected to the second carrier block.

27. The electronic communication device of claim 26, wherein the first carrier block comprises a plurality of planar surfaces, and wherein the second carrier block comprises a plurality of curved surfaces.

28. The electronic communication device of claim 27, wherein the first carrier block comprises:

a first planar surface;

a second planar surface opposite the first planar surface and with a surface area different from the first planar surface;

a third planar surface connecting the first and second planar surfaces; and an intermediate layer opposite the third planar surface and connecting the first and second planar surfaces, wherein the intermediate layer comprises a plurality of planar surfaces configured in a stair-stepped pattern.

29. The electronic communication device of claim 28, wherein the first radiator is attached to the intermediate layer.

30. The electronic communication device of claim 29, wherein the second carrier block comprises a convex rounded surface and a concave rounded surface opposite the convex rounded surface, and wherein the second radiator is attached to the convex rounded surface.

31. The electronic communication device of claim 30, wherein the first and second radiators are electrically coupled.

32. The electronic communication device of claim 31, wherein the electrical coupling is implemented via a spring finger, a screw, a pogo pin, or any combination thereof.

33. An electronic communication device comprising an antenna comprising:

a carrier comprising an internal part and an external part, wherein each of the internal and external parts comprises at least one surface; and a non-planar radiator coupled to the carrier, wherein at least part of the radiator extends over the internal part, wherein the radiator comprises a plurality of radiator branches, and wherein each radiator branch is configured to operate within a different frequency band, and wherein the internal part comprises a plurality of surfaces configured to support the entire or portion of one of the radiator branches.

34. The antenna of claim 33, wherein the plurality of surfaces are configured in a stair-stepped pattern and a curved surface.

35. The antenna of claim 33, wherein the internal part comprises an area on a surface of the carrier in which an imaginary line extending from any point in the area and normal to the area intersects another portion of the surface of the carrier, and wherein the external part comprises a portion of the surface of the carrier that is not the internal part.

* * * * *